US007048214B2

(12) United States Patent
Johnson et al.

(10) Patent No.: US 7,048,214 B2
(45) Date of Patent: May 23, 2006

(54) GYRATORY CRUSHER WITH HYDROSTATIC BEARINGS

(76) Inventors: Louis Wein Johnson, 345 Palomino Dr., Eugene, OR (US) 97401; Bruce Gordon Johnson, 26710 Alpine Cutoff Rd., Monroe, OR (US) 97456

( * ) Notice: Subject to any disclaimer, the term of this patent is extended or adjusted under 35 U.S.C. 154(b) by 0 days.

(21) Appl. No.: 10/225,778

(22) Filed: Aug. 23, 2002

(65) Prior Publication Data

US 2004/0035967 A1 Feb. 26, 2004

(51) Int. Cl.
*B02C 2/00* (2006.01)

(52) U.S. Cl. ..... 241/65; 241/207; 241/216; 241/286; 241/290

(58) Field of Classification Search ..... 241/207–215, 241/286, 290, 65
See application file for complete search history.

(56) References Cited

U.S. PATENT DOCUMENTS 3,118,623 A * 1/1964 Johnson ..... 241/207
3,207,449 A * 9/1965 Johnson ..... 241/214
3,337,143 A * 8/1967 Johnson ..... 241/215
3,759,453 A * 9/1973 Johnson ..... 241/207
4,192,472 A * 3/1980 Johnson ..... 241/215
4,351,490 A * 9/1982 Johnson ..... 241/286
4,454,994 A * 6/1984 Johnson et al. ..... 241/215
4,571,112 A * 2/1986 Johnson et al. ..... 403/320

* cited by examiner

*Primary Examiner*—Mark Rosenbaum

(57) ABSTRACT

It has been said that the wheel is the greatest invention of all time; when horses or oxen pulled wagons, dirt roads or no roads sufficed, but the wheels of modern transportation require paved roads for cars and trucks, concrete air strips for airplanes, ballast for railroads, concrete for dams, buildings, and many other things. Rock is the material that answers all these needs, but rock must be crushed to usable sizes. Big boulders or quarried rock are crushed by primary stage jaw or very large gyratory crushers that reduces the rock to sizes that second stage crushers can accept, and if the rock needs to be very small a third stage is used. Cone crushers are the crushers of choice for second and often for third stage crushing which is the type crusher of this patent application.

37 Claims, 22 Drawing Sheets

VIEW THRU B-B'

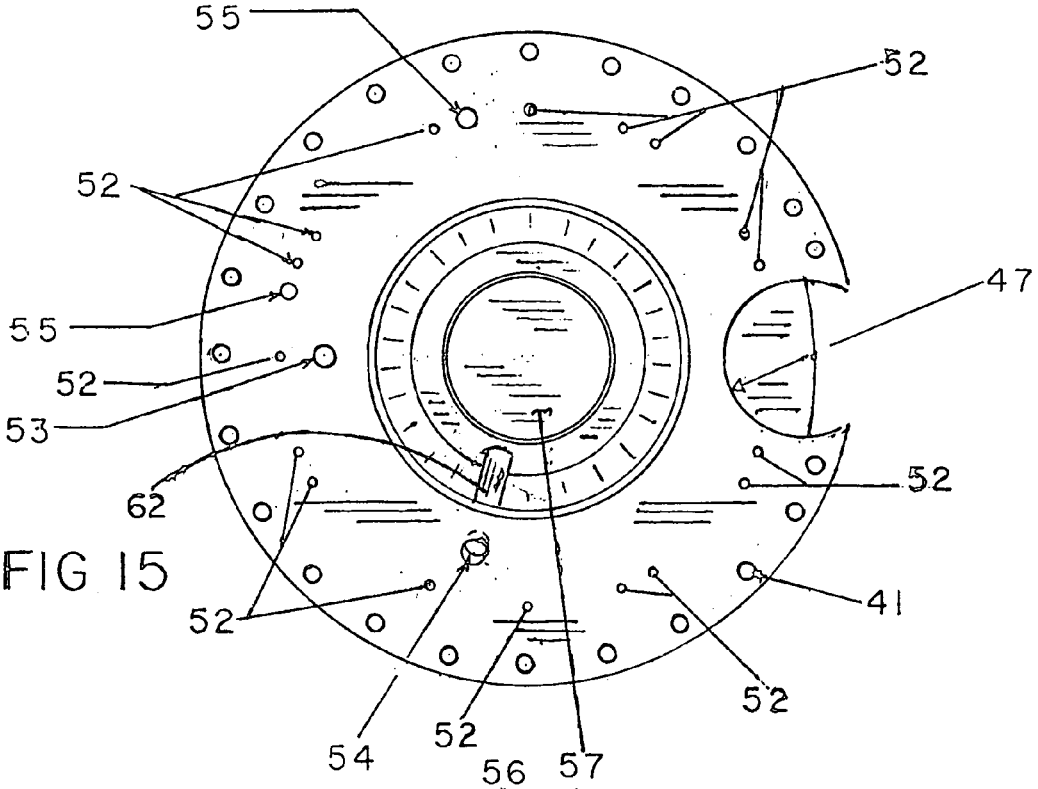
FIG 15
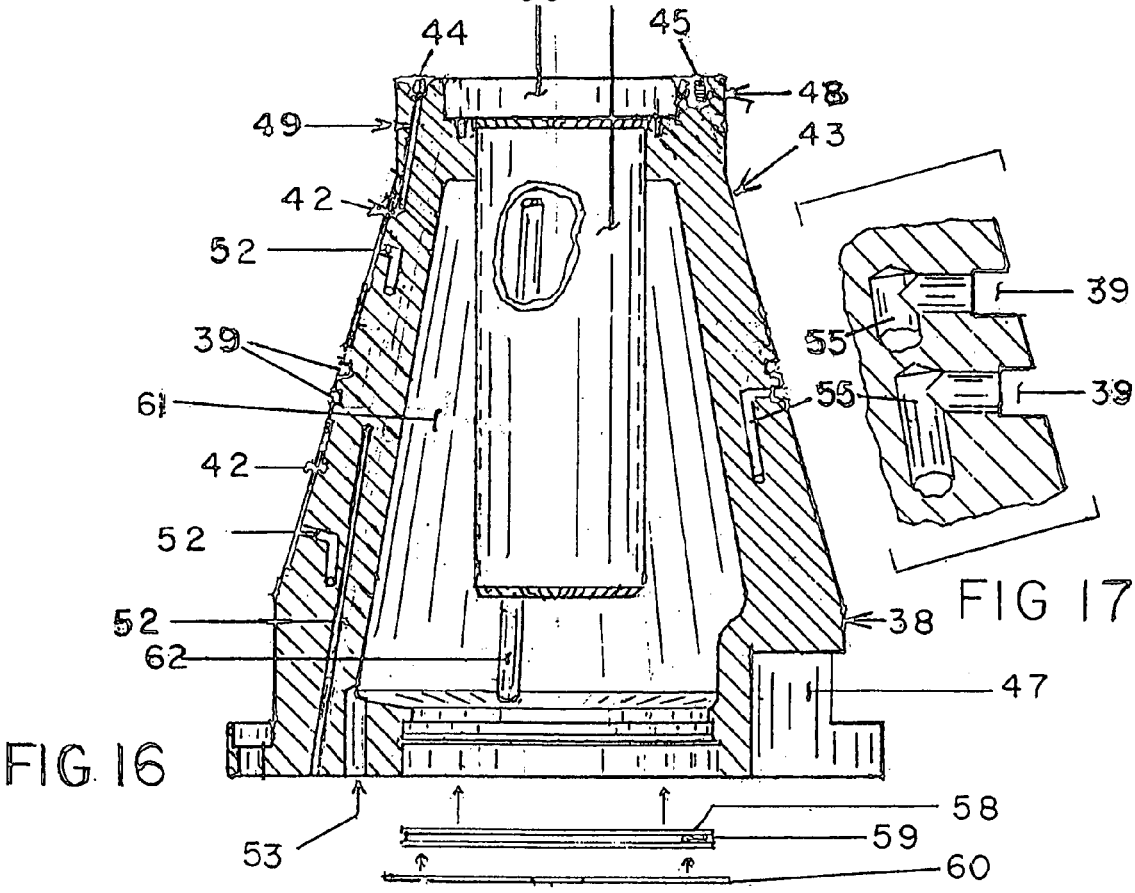
FIG 16
FIG 17

VIEW THRU G-G'

GYRATORY CRUSHER WITH HYDROSTATIC BEARINGS

BACKGROUND OF THE INVENTION

Nations can only have an advanced structure and mobile society if they have paved roads, railroads, airports, dams, buildings, foundations for houses, and countless other things that require crushed rock and other rock products; in fact, all people live in an ongoing Stone Age and always will. The volumes and tonnages of sand, gravel, crushed rock, cement, and ore far exceeds any other products in the United States. As in most businesses there is substantial competition both within the producers of rock products, and also those who manufacture machinery for such purposes. Gyrating cone crushers are the machines of choice for crushing the harder and more abrasive rock. The more efficient, durable, and economical a cone crusher can be the better it serves all concerned. Rock crushers should be structurally very strong to withstand the enormous pressures imposed, yet should not be so over designed that they become too heavy and too costly. It is more logical to use portable crushing plants at nearby rock sources to the places of use than if the hauling distances are too far from stationary commercial rock sources to the places of use; plus portable crushing plants can be built for much greater production, e.g. for highway construction, than most commercial plants. Crushers for portability must be of compact dimensions and low weight consistent with acceptable capacity and low maintenance; such a machine is the subject of our request for patent rights; it has several new concepts that will prove to be extremely advantageous for both portable and stationary use.

SUMMARY OF THE INVENTION

According to the present invention and forming a primary objective thereof, a novel combination of means to construct a very rugged and efficient rock crusher of the gyrating cone type, and to achieve this objective by designing a machine that is of less weight, lower costs to manufacture, easier to service, and more user friendly than other makes of this type of rock crushers now known. The first means is a new concept of main frame that eliminates a massive annular gear chamber and a hollow center for bearings or an embedded post shaft either of which is used by all other makes of gyrating cone type crushers. Our new design provides simple full depth straight crossbeams to better resist the enormous forces of crushing rock, ore, or other materials by the compression method of crushing. The second means is to have a better bearing concept that is far less costly than roller bearings but will run as accurately, and a bearing that is not subject to thermal clamping seizures as are bushing type bearings. A third means is the use of a double gear reduction drive between power input and an eccentric that gyrates the crushing member so as to enable the use of higher speed motors which are less costly than slower speed motors and weigh less, also smaller less costly sheaves are used. A forth means is a new concept to restrain the gyrating member from spinning when the crusher is running but not being supplied with crushable material. A fifth means is a novel way to hold a cone head mantle firmly in place by hydraulic clamping and release. A sixth means is an improved method of retaining a bowl liner within a bowl member with slidable wedges. A seventh means is a totally new concept of a tramp metal relief system where hook like means can swing outward to enable rapid removal of a bowl assembly. An eighth means having an adjusting system contained in a rigid enclosure that protects the entry of stray rocks or similar and rainfall. Within said enclosure a slidable member guided by roller means and actuated by hydraulic means and having a pivoting pawl to engage vertical spaced apart lugs attached to a ring like member; said hydraulic means push and pull said slidable member that will turn said ring like member when said pawls are engaging said lugs. Said pawl engages and disengages said lugs by hydraulic means. Two of said enclosures are used and are 180° apart for balanced thrust.

BRIEF DESCRIPTION OF THE DRAWINGS

Having introduced the purpose of this application, we now list the numbers that we have assigned to its parts. We refer to FIGS. 1 through 49. The purpose each part serves will be explained later.

FIG. 7 is a plan view of member 10: 21 is a precision bore, 30 is a gear inspection hole, 142 is a lube hole 14 is an oil trap; 33 and 34 are larger oil holes than 17, 25 and 26 are heating/cooling fluid holes, 27 is an annular oil drain;

FIG. 8 is a detail view through E–E': 16 are recesses for elastomer seals at the top ends of all oil and heating/coolant holes shown in FIG. 7.

FIG. 9 is a detailed view of 13 and 27 taken through F–F' FIG. 7;

FIG. 10 is a detailed view taken through D–D' of FIG. 7 showing deflector 14 and nozzle 15.

FIG. 15 is a plan view of the bottom face of spindle 38; 41 are multiple bolt holes; 52 are multiple lube oil holes; 55 are oil holes; 53 is a fluid inlet; 54 is a fluid outlet;

FIG. 16 is a vertical sectioned view of spindle 38 taken through gear opening 47; 61 is a cast hollow chamber; 62 is an overflow exit tube; 57 is a fluid tight tubular chamber; 56 is a precision bored recess; 58 is a solid disk; 59 is an elastomer seal ring in 58; 60 is a retaining ring;

FIG. 17 is an enlarged view of annular grooves 39

18 is for all drains not otherwise numbered and is used in several different FIGs.

DETAILED DESCRIPTION OF DESIGN OF PREFERRED EMBODIMENTS

Figure 1:
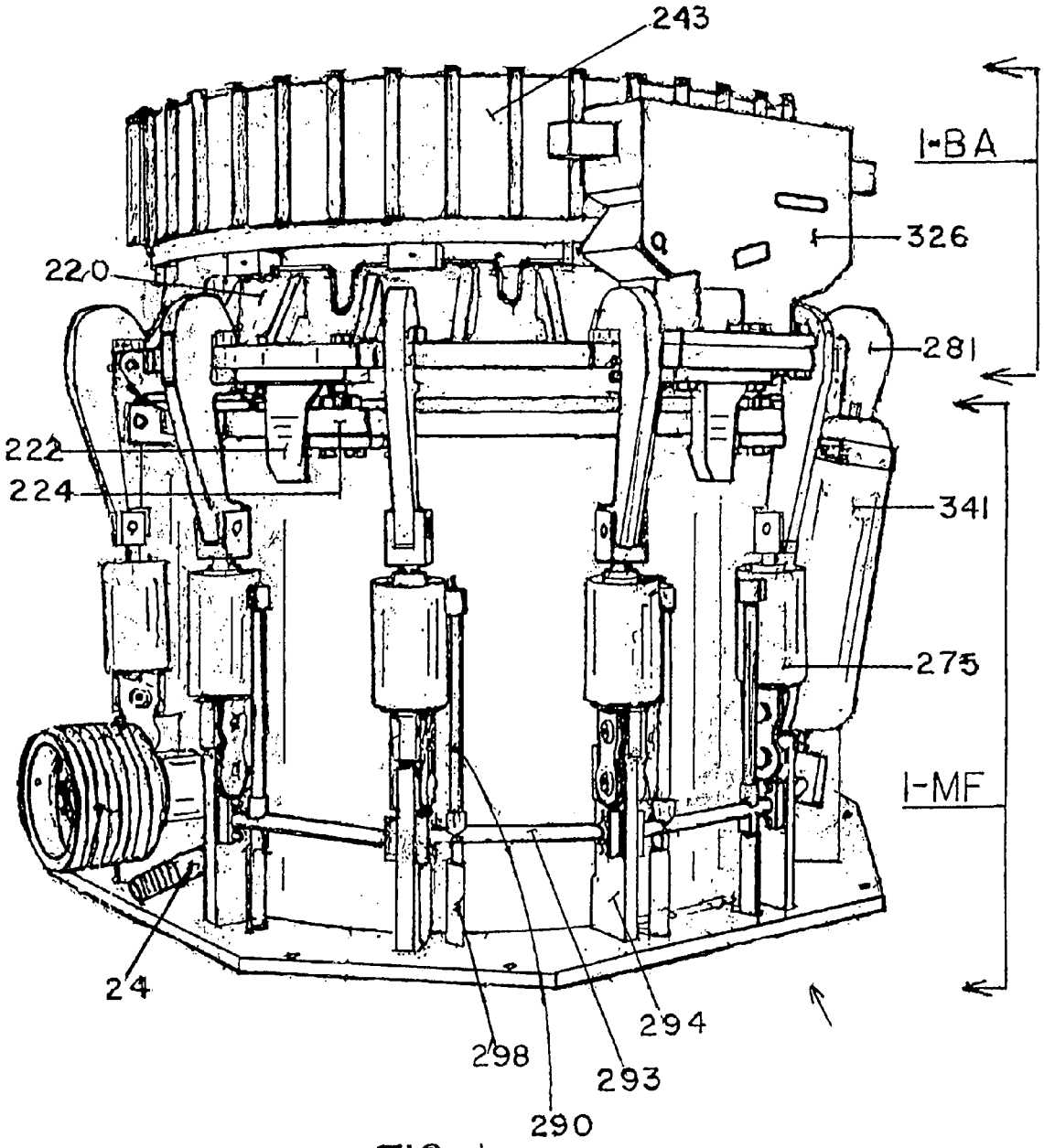
FIG. 1 is a perspective view of our fully assembled rock crusher; 1-MF is the main frame; 1-BA is the bowl assembly; 326 is an adjusting unit; 341 is a gas charge accumulator; 281 are hook-like members; 275 are hydraulic cylinder assemblies; 294 are anchor plates; 293 are manifold tubes; 290 are manifold to cylinder tubes; 298 are thrust absorbing members; 24 is a lube oil drain; 224 are anti-rotation stop blocks; 222 are depending arm anti-rotation stops; 220 is a bowl nut; 243 is an adjustment ring.

FIG. 1 shows a perspective view of a fully assembled rock crusher that is the subject of our invention. The numbered parts are shown in detail on pages 3 through 22 and FIGS. 3 through 49 of the drawings. In FIG. 1: 341 is one of two gas-pressurized accumulators; a second accumulator, out of view, works in parallel with 341 to provide ample capacity for their duty which is to minimize pressure increase caused by rapid inflow of oil compressing the gas confined within an elastomer bag inside the steel chambers of the accumulators; this construction is a spring with an extremely low spring rate as compared to coiled steel springs, and coil springs have a very limited travel before their coils contact together. However, a cylinder-piston design can be of any useful travel if the accumulators are of adequate capacity. Both accumulators are connected to manifold tubes 293; vertical tubes 290 conduct pressurized oil from 293 to the tops of the hydraulic cylinders 275; this makes the cylinders of the pull design. Hook shaped members 281 are connected to hydraulic cylinders 275. Columns 298 transfer the thrust of 290*s* into the main frame 1-MF, because 290*s* have slip connections at each of their ends and therefore act like pistons. The object of this new concept is to provide extremely rapid and easy removal of the bowl assembly 1-BA from the main frame; two workers can release the accumulator pressure and tilt the swing hooks and cylinders clear of the flange of 1-BA and attach lifting cables and a crane with an operator can have the bowl assembly sitting on the ground within twenty minutes; other designs common in cone crushers require several man hours to remove large nuts and nut locking devises plus careful guidance by several men when lifting their bowl assembly over many large threaded rods and repeating such care at reassembly.

For example: our new unique system enables two men plus a crane operator to remove the bowl assembly from the main frame, remove worn mantle and bowl liner, replace with new, pour backing epoxy, and fully reassemble within three hours in the more popular mid size crushers; no other cone crusher can closely match this. When down time is factored in of such costly operations as rock plants are, the cost savings of our design are enormous! 24 is a lube oil drain to a reservoir not shown; 224 is one of several stop blocks that resist the torque of depending arms 222. In cone type crushers there is a main frame, and resting upon it is a removable bowl assembly that is designed to lift when uncrushable objects enter the crushing chamber; also there is a tendency for the bowl to "float" slightly during very severe crushing; these actions causes the bowl assembly to try to creep relative to the main frame; this can not be permitted, hence the anti-rotation stops; usually there is wear between anti-rotation stops with all makes of cone crushers, with our design 224 is reversible and 222 can be removed, repaired with weld metal, and reattached; this can also be done with 224. Pressures in GAS over OIL design are adjusted to resist lifting of the bowl assembly when crushing rock but to allow lift by uncrushable objects; Louis Johnson, co-inventor of this application, is the original inventor of combining accumulators with hydraulics for rock crusher protection systems; see Johnson U.S. Pat. No. 3,118,623 and U.S. Pat. No. 4,192,472. 1-BA is a bowl assembly that contains a rotatable member to which is attached 243 adjustment ring; 326 is one of two opposed power adjusters that rotate 243, when activated the crusher product is sized as desired.

Figure 2:
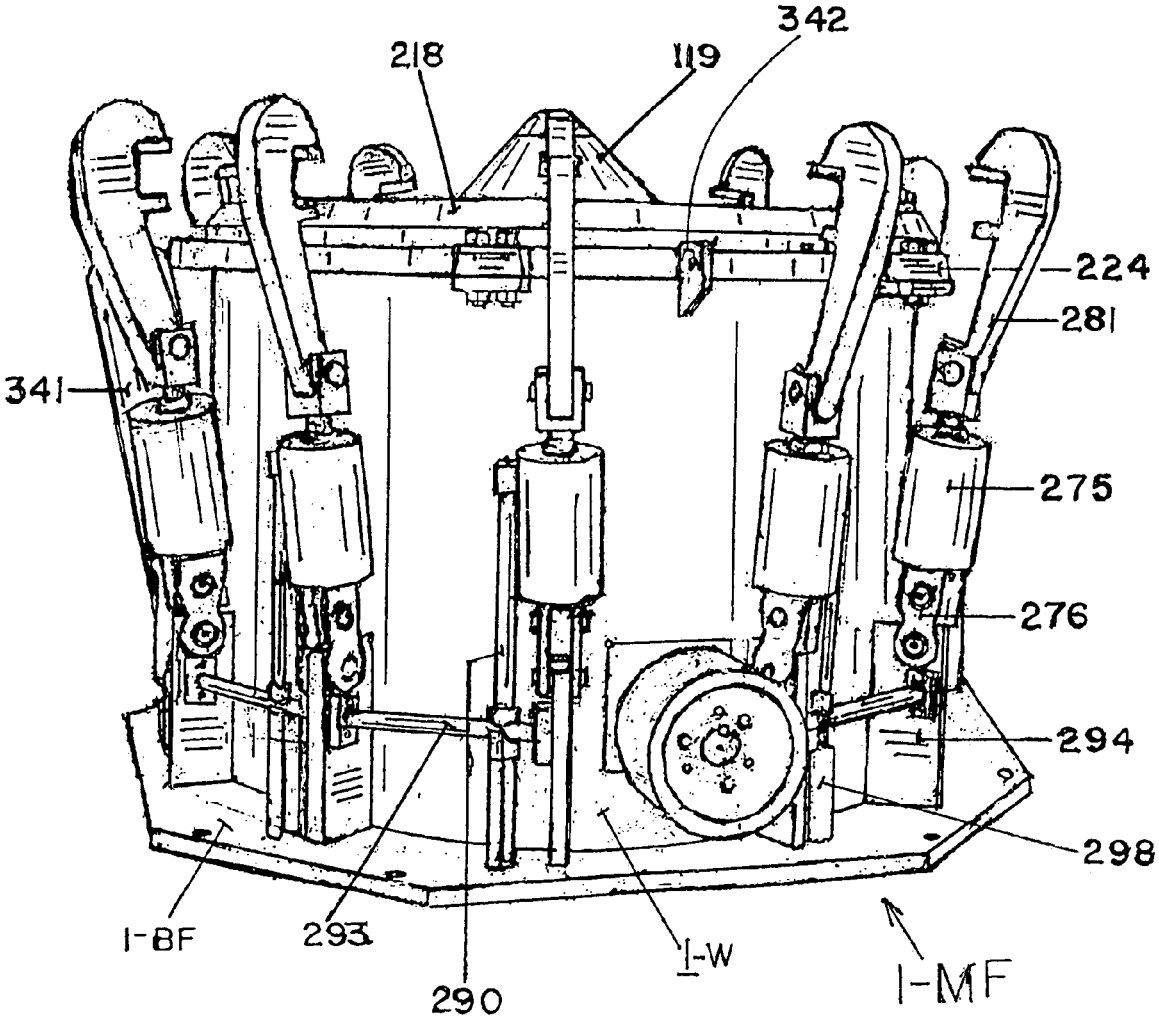
FIG. 2 shows a perspective view of the main frame with hydraulic cylinders 275 and hook-like members 281 tilted outward; 276 are connecting links; 1-BF is a base flange, and 1-W is a cylindrical wall of the main frame 1-MF; 218 is a V-ring; 119 is a wear mantle; 342 are lifting brackets.

FIG. 2 shows the main frame with bowl assembly removed; hooks 281 and cylinders 275 are tilted outward to their stop positions thereby providing ample clearances for lifting the entire bowl assembly; 218 is a hard steel V-ring pressed into the top of the main frame, and upon which bowl nut 220 seats, FIG. 1; 119 is a wear mantle seated on a cone-head and retained by a combined hydraulic piston and cap screw unit; 342 is one of three lifting brackets; 276 are links that connect 275 to 294 and allow limited tilting of 275.

Figure 3:
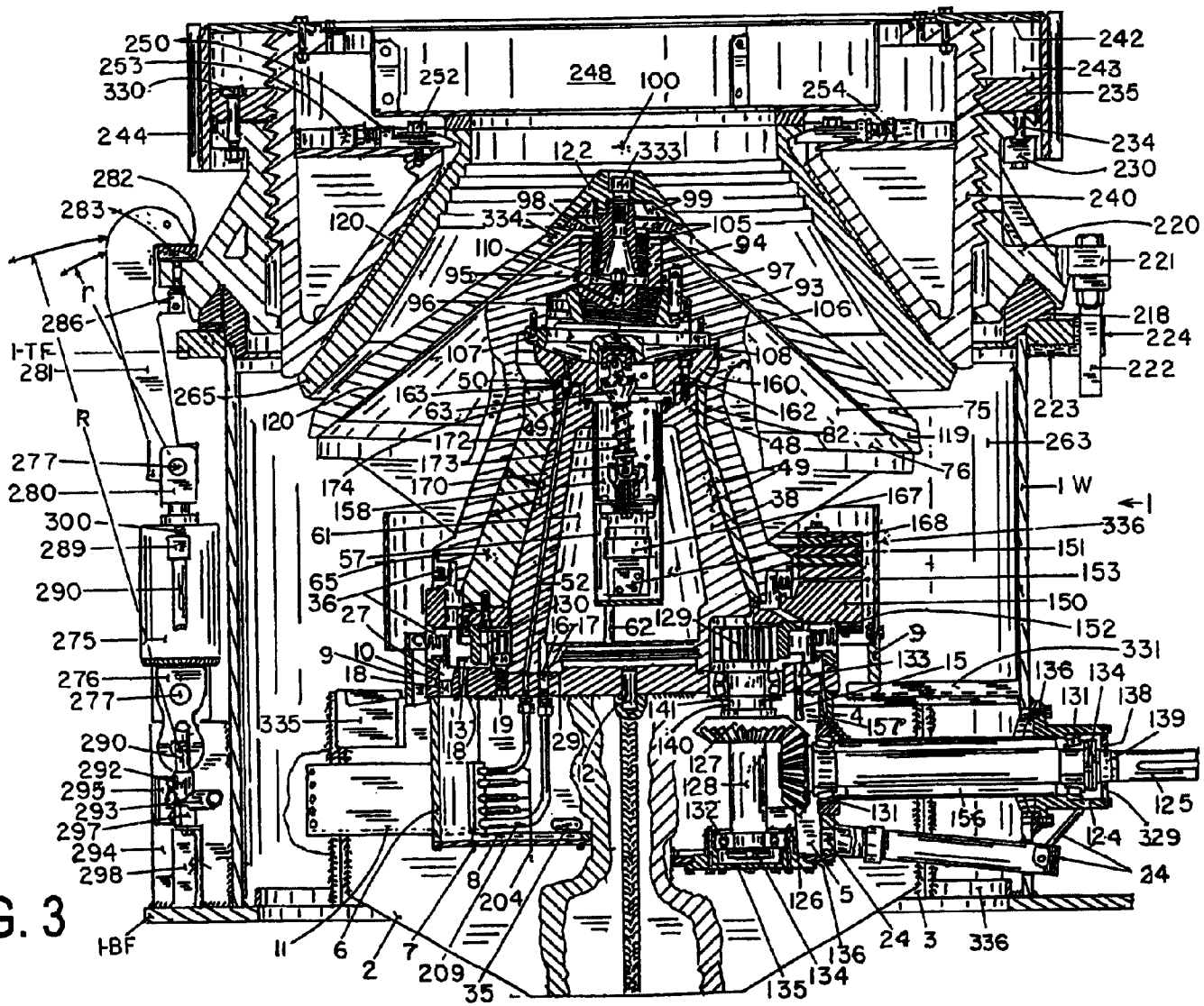
FIG. 3 is a vertical section view through the crusher; 331 is a spacer brace and a wear protector; 263 is a wear liner; 333 is a large socket head cap screw; other numbers are detailed in subsequent FIGs; plus other numbered features that cannot be shown in this view.
Figures 30, 31:
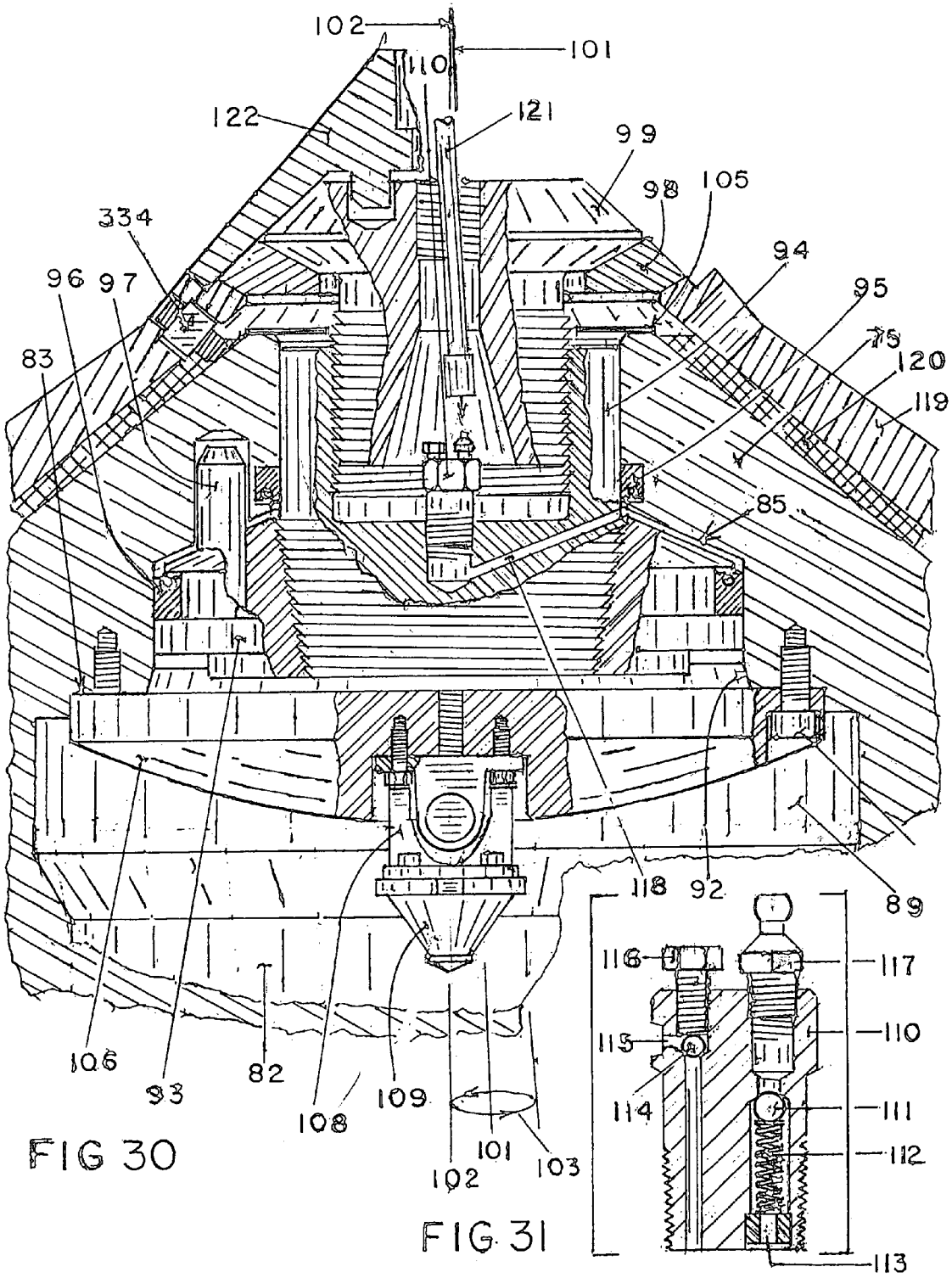
FIG. 30 is enlarged vertical section view of an assembled cone head; 93 is a piston; 94 is a cylindrical extension threaded into 93; 95 is an elastomer seal ring; 96 is an elastomer seal ring; 97 are pins; 105 is a copper ring; 120 is backing material; 98 is a conical washer-spacer; 99 is a cap screw with a double conical head; 122 is a protection wear cap retained by cap screw 333 see FIG. 3; 334 is a set screw and nut; 110 is the body of a valve; 118 is an oil hole; 121 is an oil pump extension; 106 is a spherical thrust bearing member; 107 are cap screws; 108 is a universal joint; 109 is half of a jaw clutch with a conical extension; 103 is the amplitude of gyration.
FIG. 31 is an enlarge sectional view of 110; 111 is a ball; 112 is a spring; 113 is a headless screw with a hex hole through it; 114 is a ball; 115 is a vent; 116 is a cap screw; 117 is an oil gun fitting.

FIG. 3 is vertical section view taken through the gear train; it shows how most of the parts fit together; the numerous numbers are required to point out all the new concepts of our invention as well as those parts that are not new art but essential to assist in understanding our machine; 331 braces the wall 1-W to maintain the exact spacing between 1-W and plate 4 and to prevent any erosion of bearing housing 156 by falling rock; 263 is a sectioned wear liner that protects wall 1-W from rock erosion and is held by bolts for easy replacement; 333 is a large socket head cap screw that holds wear cap 122 which protects 99 a conical headed cap screw; FIG. 30 details said concepts. Other numbers are detailed in the following pages.

Figure 4:
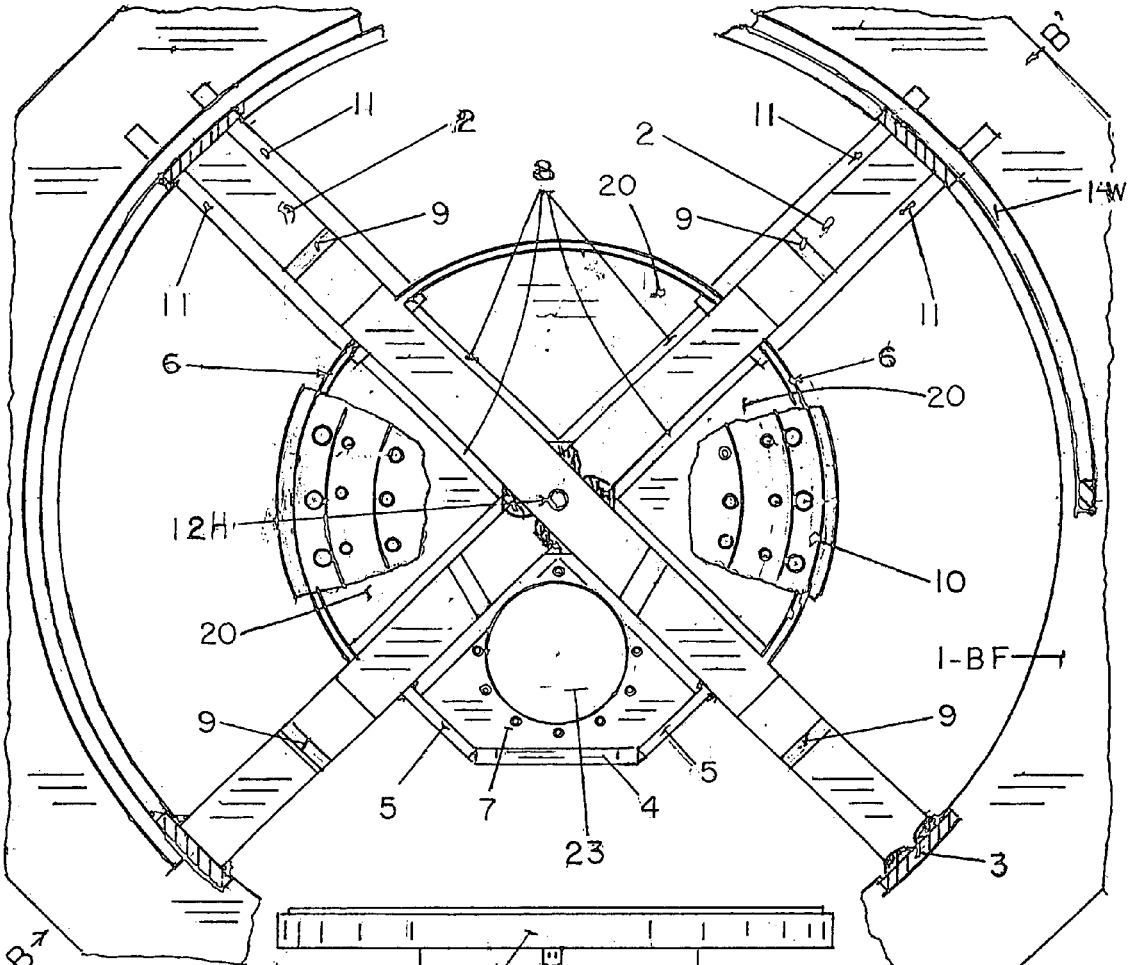
FIG. 4 is a plan view of the lower half of the main frame; 1-BF is the bottom flange of said main frame; 2 are beams; 3 are end plates welded to beams; 4 is a bearing housing support with precision bore 22 and drain port 24 integral; 5 are support plates for 4; 7 is a bearing housing support; 23 is a precision bore in 7; 6 are arcuated walls; 9 are upright members; 10 is a circular plate member; 12 is a centering pin in 10; 12-H is a centering hole in beams 2; 11 are lube oil conducting members; 8 are attachment shelves; 20 are cover plates.
Figure 5:
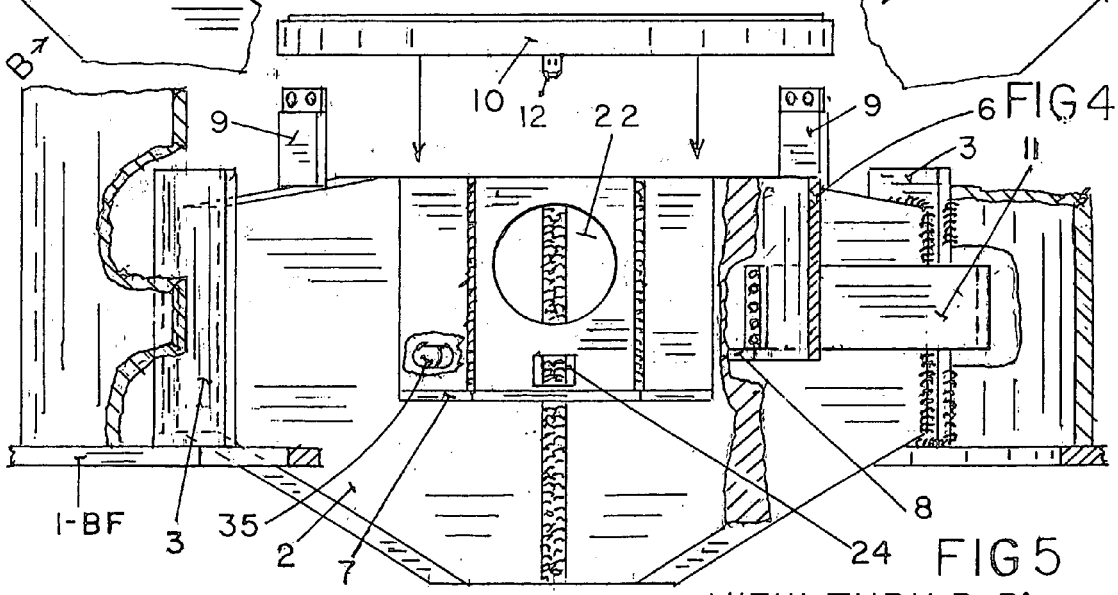
FIG. 5 is a vertical sectioned view through B–B' FIG. 4; 35 are oil drain ports in beams.
Figures 41, 42:
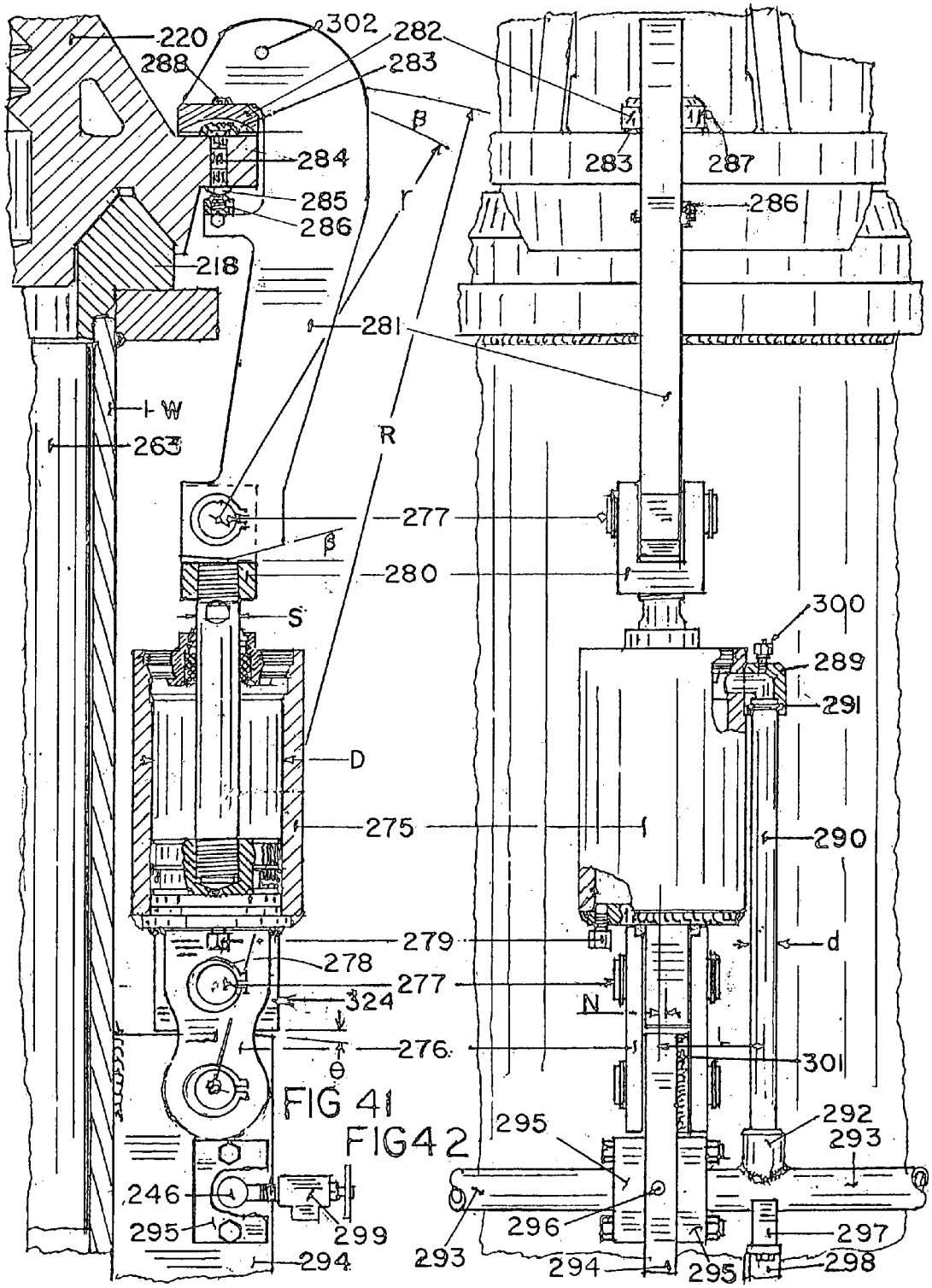
FIG. 41 is a tangential vertical view of one assembly of our relief system; 294 are anchor members; 246 is a hole for oil passage; 299 is a valve; 295 are header plates; 299 is a valve; 276 are links; 277 are pins; 278 are retaining rings; θ is a limiting angle; 279 are air filters; 275 is a sectioned view of a cylinder assembly; $_D$is cylinder diameter; $_s$is ram diameter; 280 are clevises; β is a limiting angle; 281 are hook like members; 282 are concave discs; 283 are convex pads having positioning stems; 284 are precision holes; 285 are spherical headed shoulder pins; 286 are threaded blocks with headless screws; $_R$is a long radius centered at lowest 277 pin; $_r$is a shorter radius centered at clevis pin.
FIG. 42 is a radial view of FIG. 41; 287 is a lubrication fitting; 293 is a tube manifold with slip connector 292 joined to it; 275 is a partially sectioned view of a whole cylinder; 297 are saddle blocks; 298 shows the top end of a thrust transfer member; 296 is a threaded hole into one 294; 289 is a 90 deg. attachment to 275; 290 is a connecting tube of $_d$diameter; 300 is an air bleed valve; 301 is a spacing pad.
Figure 44:
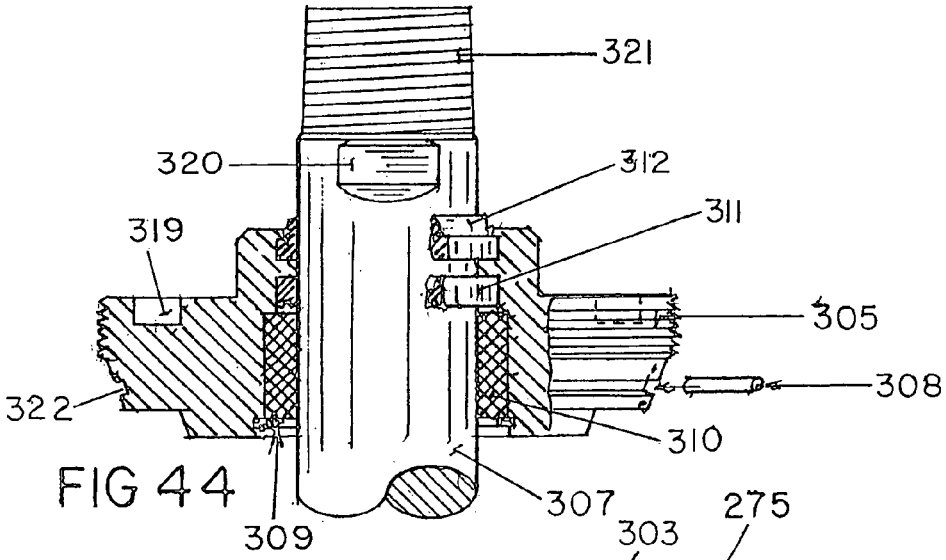
FIG. 44: 305 is a threaded cylinder head; 322 is a seal ring groove 308 is an elastomer seal; 310 is a bushing; 309 is a retaining ring; 311 is an elastomer seal; 312 is a rod wiper; 320 are wrenching flats; 321 is a taper thread; 319 are recesses for pin wrench.

FIG. 4 is a plan view of lower section of the main frame; 2 are full depth crossbeams spanning across the inside diameter of 1-W less the thickness of endplates number 3 the outer faces of which are machined to the same radius as 1-W's inside diameter; beams 2 are configured to have near uniform strength across their lengths; one beam is full length with two half length beams minus thickness of first beam forming the other beam; all said beams are prep machined including drains 35 before being fully welded together to form a 90° X frame; the central top faces of said beams are machined flat and square to the vertical centerline of said main frame; members 8 each are blind threaded to receive cap screws and are then positioned and welded to each side of beams 2 in all four quadrants; arcuated members 6 are premachined prior to being positioned at the same radius through three quadrants; the bottom faces of 8 and 6 are on the same plane; members 4 and two 5*s* form a support for a bevel gear housing. All members forming said quadrants are fully welded before the upper faces of members 4, 5, and 6 are face machined simultaneously with beams 2 with all in the same plane; the radius of members 3 are machined concentric to the frame's axis and to the same radius as the inside diameter of wall 1-W, and lower ends are machined 90° to centerline and to an exact distance below the top faces of beams 2; cover plates 20 are attached to 8 and 6 with gaskets between by cap screws at final assembly of a complete machine. Member 10 is fully machined before welding; pin 12 is inserted at its center before it engages hole 12-H which centers 10 on beams 2; bore 21 in member 10, FIG. 7; 10 is positioned precisely with a gage over bore 23 in plate 7; 10 is welded to 2*s* at specified places and fully welded to 4, 5, and 6; welding is accessible through the openings that will be closed by covers 20; this procedure forms four oil tight chambers and adds strength and stiffness to beams 2 and saves time and costs of vertically machining the two bores later and premachines parts that are inaccessible after assembly. After this procedure is complete, the assembly is positioned on base flange 1-BF and secured with welds; cylinderical wall, 1-W, is a rolled steel plate without its ends joined; it is wrapped around said assembly with one end centered on one end plate 3; 1-W is forced to match a circular score line etched into 1-BF when it was premachined and is tack welded as necessary when being positioned through 360°; its joining gap is then welded about the height of member 3. A top flange 1-TF, FIG. 3, is machined to an inside diameter equal to the outside diameter of members 3 plus two wall thickness of 1-W, and the outside diameter is oversized, and one side is faced with a small chamfer at its inside diameter, and 1-W has a small hand ground chamfer at its outer top edge to facilitate said flange to being forced over said wall to an exact distance above 1-BF; both are skip welded as 1-W is forced against 1-TF free of any gaps; anchor plates 294, FIGS. 3 and 41, are positioned and partially welded. The whole assembly is now ready for complete welding; after which the top inside diameter of 1-W and top face of 1-TF and its O.D. are machined to specific dimensions. Any top face warpage to 10 by welding is corrected by machining at this time. Upright members 9 are supports for shield 336 FIG. 3. FIG. 5 is a vertical sectioned taken through B–B'; it shows the full depth of beams 2, the frontal position of members 4 and 5 with precision bore 22 that supports a pinion shaft housing 156, oil drains 24 and 35, and the position of member 7 that serves both as a cover and support for a bearing housing, bearing, a vertical shaft with a bevel gear attached, and the separating forces of the bevel gear. Arrows show where member 10 will be placed. A cutaway in the $2^{nd}$ quadrant shows the end of a member 11 within a member 6 and oil holes drilled through 11.

Figures 6, 7:
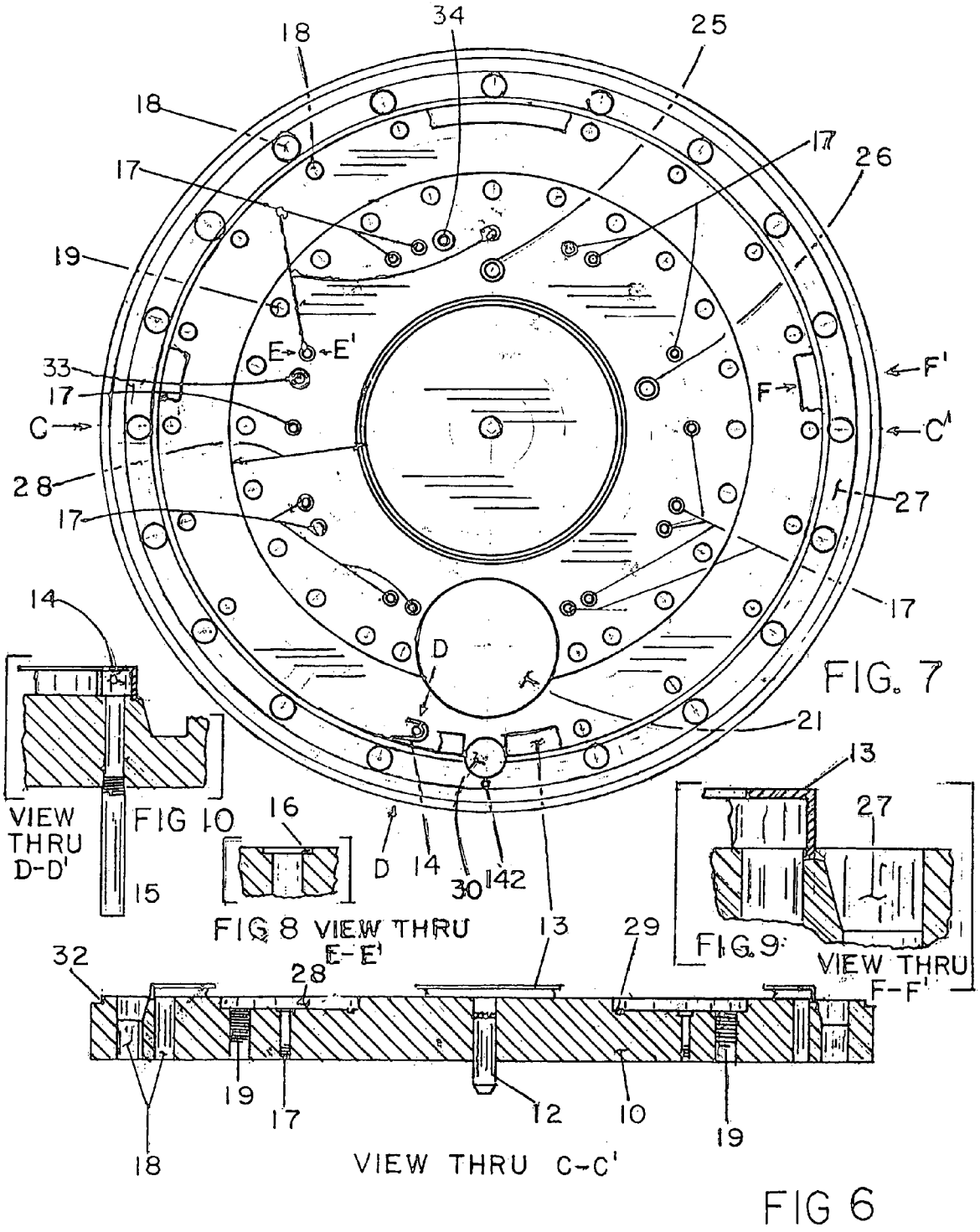
FIG. 6 is a vertical sectioned view taken through C–C' of member 10
FIG. 7 showing centering pin 12, 17 are lube oil holes, 19 are threaded holes, 18 are drain holes, 13 is an oil deflector ring, 28 is a precision recess, 29 is seal groove, 32 is a seal ring shoulder.

FIG. 6 is a vertical sectioned view of member 10 taken through C–C' FIG. 7. 10 is a steel plate of substantial thickness to cope with severe stresses and to provide adequate depth for recess 28 and threaded holes 19 and for the width of a roller bearing in bore 21; 32 is an annular positive angled shoulder over which is shrunk fit a seal ring spacer. FIG. 7 is a plan view that details member 10's construction before welding to beams 2 and arcuated members 6. The top face of member 10 is recessed at 28 to exact inner and outer diameters to match a press fit to member 38, FIG. 12, a spindle; the walls of 28 absorb huge shearing stresses; multiple holes 19 are precision drilled and threaded for large cap screws to pull said spindle tightly against the bottom face of recess 28; bore 21 is precision bored an exact distance from center for accurate gear meshing; a roller bearing seats in this bore; holes 17 with recesses 16 FIG. 8 are precisely positioned as are holes, 33, 34, 25, and 26 to match holes in said spindle; 30 is a gear inspection hole; FIG. 9 is an enlarged section of groove 27, an annular recess to divert oil to drains 18, and a boss for positioning member 13; multiple drain holes 18 are positioned to avoid being obstructed by beams 2; hole 12-H is drilled on center to accurately position member 10; boss 32 is machined to hold a seal spacer; the bottom surface of member 10 is faced, and holes 17, 25, 26, 33, 34, and for nozzle 15 are threaded; hole 142 is drilled after the base frame is virtually completed. FIG. 9 details 13 a lube oil deflecter to channel oil to drains 18. NOTE number 18 is used at several places and FIGs to represent oil drains. FIG. 10 details 14 an oil trap to force lube oil into nozzle 15 that ejects lube oil just ahead of the meshing of gears 126 and 127.

Figure 11:
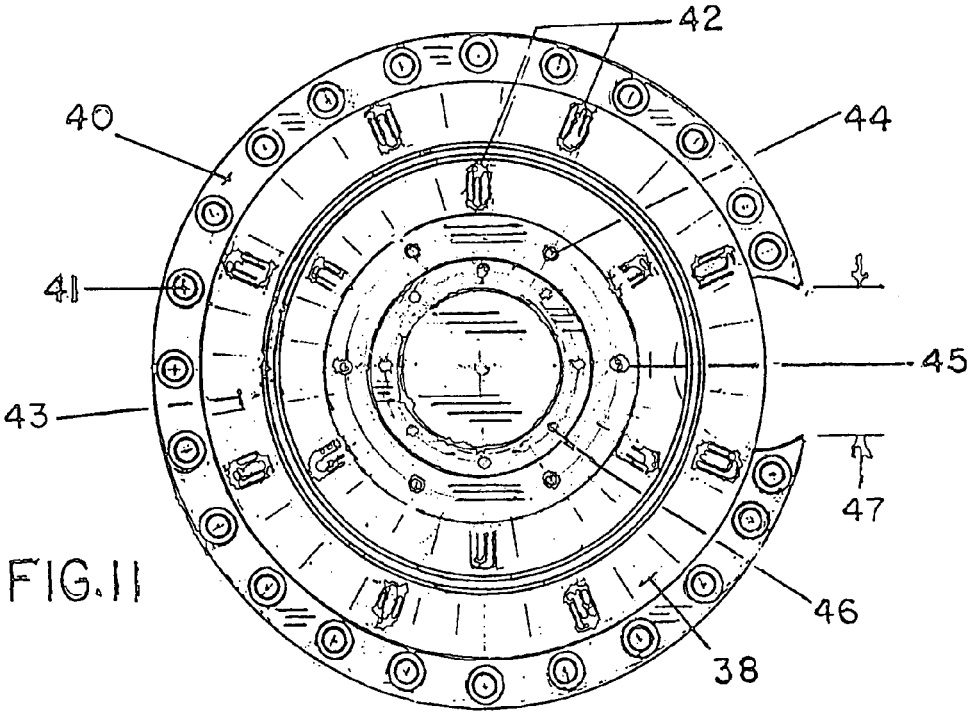
FIG. 11 is a plan view of the top of member 38 a fixed spindle; 40 is a bolting flange with counterbored holes 41; 42 are flutes (grooves) with tapered edges; 44 are three evenly spaced smooth bored holes; 45 are evenly spaced threaded holes; 47 is opening for a gear; 46 are multiple threaded holes in a recessed face; 43 is a conical surface.
Figure 14:
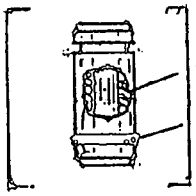
FIG. 14 details transfer nipples 50 with one of two elastomer seal rings 51 in place.
Figure 12:
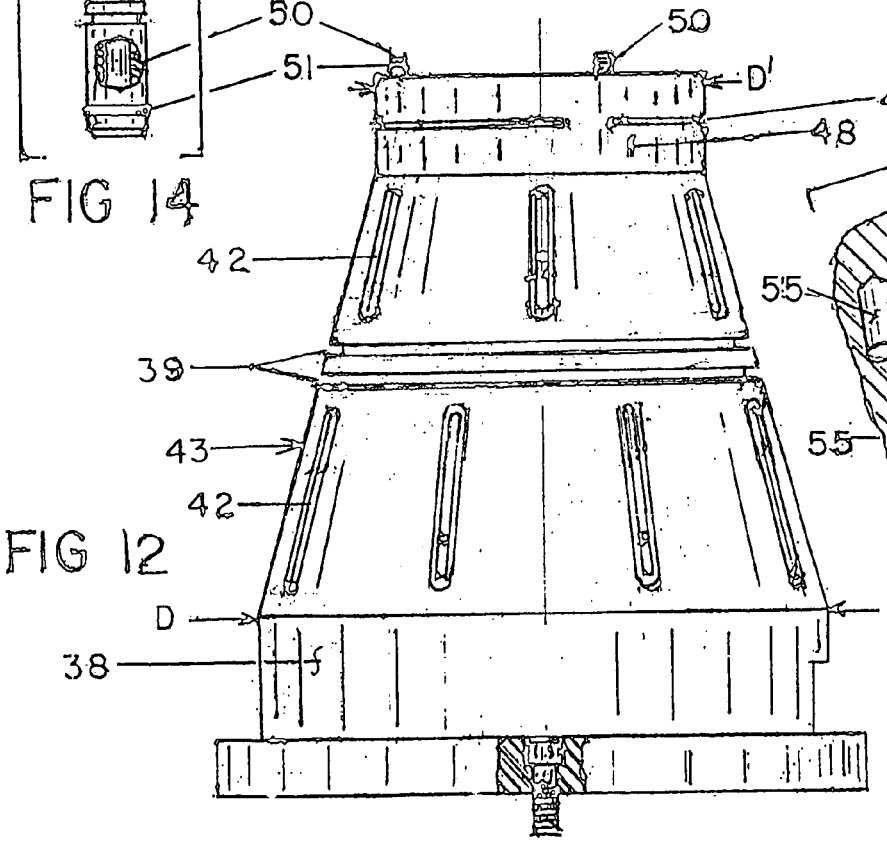
FIG. 12 is a vertical view of 38; $_{D}$is a large diameter of taper 43 and $_{D'}$ is its small diameter; 48 is a cylindrical extension of $_{D'}$ diameter; 49 are hydrostatic lubrication grooves; 39; are annular grooved lube oil distributors.
Figure 13:
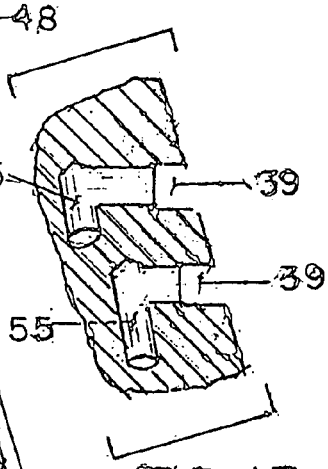
FIG. 13 is a detail of grooves 39 and 55 oil lines.

FIGS. 11 &12 shows a spindle 38 that is force fit into recess 28 in member 10 by multiple cap screws. This construction accommodates both shearing and tipping forces that are huge in cone crushers, and because it is secured by cap screws and extracted by jack screws, this spindle is easy to service or be replaced by a new one even as the main frame remains in its working position. Other makes of cone crushers that use an embedded post shaft design have extreme difficulties to extract its shaft because of the very tight shrink or press fits extending through the full depth of their center member as such designs require, and such machines must be removed and be hauled to a repair shop if their post shaft must be replaced, all of which is very costly and time consuming. Except for the crusher design of this patent application all other cone type crushers whether post shafted or open for an eccentric mechanism have massive deep and wide annular center sections cast integral with radial arms and are recessed to accommodate a large bevel gear; these crushers must be built as such to resist deflecting cycling forces which cannot be totally contained; such construction adds substantially to the weight and costs of those machines. Such stresses and deflections do not transfer into our bearing design. FIG. 12 shows the conical construction, 43, of our new concept design that has a cross-sectioned area at $_{D}$dimension and a smaller cross-sectioned area at $_{D}$'; subtracting area at $_{D}$' from area at $_{D}$gives an area equal to an area in a plane of the same outside and inside diameters. We use this as a thrust bearing area. A cylindrical extension 48 of $_{D}$' diameter stabilizes an eccentric member, 65 FIG. 18, when the hydrostatic oil film between the conical surfaces is too thick. The area difference of $_{D}$minus $_{D}$is substantial enough to provide an adequate hydrostatic thrust bearing when lube oil under pressure is injected into flutes 42 and between bearing surfaces; the conical shape is large enough to eliminate diametral clamping by thermal shrinkage of metals of different coefficients of expansion, a severe problem with straight shafted crushers that use bronze bushings, because such bushings are heated by friction and try to expand against a much stronger steel or iron housing which is cooler and has a lower coefficient of expansion by a factor of about 60%; the results are the bushings are compressed, and when the crushers are shut down and bushings cool, they shrink to a smaller diameter and would clamp and seize to shafts they work against; the only way such crushers can cope with this phenomenon is to have excessive bearing clearances larger than the amount of shrinkage, but this in turn greatly reduces radial bearing area caused by diverging arcs and also causes inaccurate meshing of bevel gear drives, because the larger gear orbits true center by whatever the extra clearance may be which causes reverse end loading of the gear teeth during every 180° s of rotation. Also constant shrinking and expanding between operating and shut down of the machine causes myriads of tiny cracks in the bushings that resemble a dried mud flat; the oil film is disrupted adversely affecting lubrication. Our one piece design sans bushings permits a nearly uniform oil film thickness through 360° because any differences of expansion between dissimilar metals is accommodated by the eccentric member lowering on the tapers if it expands, and if it shrinks, it climbs relative to the spindle on which it runs; while the eccentric loading may force a slight difference in oil film thickness to absolute true running, it is of no consequences, because our eccentric gear's teeth are parallel to its axis, vertical movements and meshing clearances accommodate any slight changes in depth of meshing. With its hydrostatic lubrication our bearing finds its bearing clearances in proportion to the imposed loads; injected oil is at a volume and pressures that prevents metal to metal contact; the results are running accuracies comparable to roller bearings, with very low friction and wear and not subject to cracking as with bushings nor fatigue spalling as are roller bearings. Original and maintenance costs are substantially less with our design. However, our hydrostatic bearings were not without fault; when operating unloaded, a surplus of oil and varying viscosities caused too thick an oil film which created instability to the eccentric and cone head; after extensive testing we corrected the problem by adding the short cylinderical sections, 48 FIG. 12, at the top portion of the spindle to stabilizes the eccentric and cone head 75 FIG. 3 and FIG. 27. FIG. 11' is a plan view of the top of said spindle; 40 is a bolting flange; 41 are multiple countersunk holes for large socket head cap screws; 43 is a conical super accurate smooth surface its full length; 39 are two annular grooves that deliver lube oil to holes rotating with an eccentric member 65; said grooves are detailed in FIG. 13 with oil holes 55; tubes 50 with seals 51 transfer hydrostatic lube oil across a shimming space 163 between said spindle and a thrust bearing body, 160 FIG. 33; 49 are spaced apart annular grooves around extension 48 to supply hydrostatic lubrication between the bearing surface of 48 and eccentric member 65; 44 are three equally spaced smooth wall holes for tubes 50; 45 are threaded holes for retaining said thrust bearing; 46 are multiple threaded holes for retaining a tubular chamber 158 FIG. 33; 47 is a chamber enclosing a spur gear. Surfaces 43 and 48 are machined to near zero tolerances and extremely smooth finishes; the fluting 42 in the spindle is evenly spaced above and below the annular galleries 39. Oil volume is proportional between to the areas of the two zones, but is equalized to each flute by flow dividers; lube oil is supplied at whatever pressures and volume required; the varying loads of crushing vary the operating clearances, and the escape rate of oil at the ends of each bearing is similar to a variable valve, but at some point of clearance the escape rate reaches a limit that prevents further restrictions of closure because the pump pressures are always greater than crushing pressures, and volume is virtually constant. Our research has not revealed that a unidirectional conical hydrostatic bearing capable of coping with simultaneous radial and thrust loading has ever been used before in any kind of a machine. A thrust bearing positioned on top of said spindle is held in place by a slight press fit in bore 56 FIG. 16, and by cap screws threaded into holes 45; FIG. 14 details tubes 50 sealed by O-rings 51 that transfer lube oil across the space between the spindle and thrust bearing providing hydrostatic lubrication from gun drilled holes from the base of 38 to holes 44 which transfer oil to tubes 50.

FIG. 16 shows a vertically sectioned view of said spindle an alloyed steel casting capable of being cryogenically hardened after machining; 61 is an as cast hollow chamber with an inlet 53 designed to swirl incoming fluid, and an overflow outlet 62 designed to flow a heating/coolant fluid through said chamber thereby heating or cooling the actuating members of the machine as local weather temperatures and operating temperatures may require, and to help keep lube oil at an optimum viscosity range; heating or cooling from the inside out is more efficient, safer and simpler than flame heating the outside of the gyrating assembly as is done when other cone crushers are shut down between shifts in very cold weather, and heating or cooling lube oil is done within an exterior tank. Said fluid flows through a heating unit or through a fan cooled radiator, or in extremely hot climates a chiller maybe needed before said fluid enters cavity 61; 52 are gun drilled holes to conduct lube oil to each designated flute 42 and to thrust bearing 160 some of which is shared with grooves 49; 56 is a precision bored recess for a tight fit with thrust bearing body 160; 57 is a fluid tight tubular member to enclose a hydraulic motor 167 FIG. 33; 58 is a solid disc cover with a sealing ring 59 and is retained in place by ring 60 that engages a groove; an option is to weld 58 fluid tight; its purpose is to prevent heating/cooling fluid from mixing with lube oil; oil lines and heating/cooling lines from members 11 connect to designated connections in member 10; holes 17 align to holes 52, and hole 33 aligns to hole 55 and hole 34 aligns to other hole 55; holes 52 and 55 carry lube oil; holes 53 and 54 carry a water antifreeze mix; all said holes are sealed with elastomer seals in recesses 16. Holes 52 deliver lube oil in equal volume to designated flutes in said spindle 38 to lift and lubricate eccentric 65 and to the thrust bearing less what goes to grooves 49; oil holes 55 FIG. 17 deliver lube oil to annular grooves 39 that continually supply lube oil to holes 68 through eccentric member 65 as it rotates around the spindle, page 8 FIGS. 18 and 20, to lubricate the conical bearing surface 81 of cone head 75 and matching surface of eccentric 65. Hole 53 delivers and swirls heating/coolant fluid to chamber 61 within said spindle, and tube 62 withdraws it near the top of said chamber; this insures a full chamber of agitated fluid.

Figures 18, 19, 20, 21:
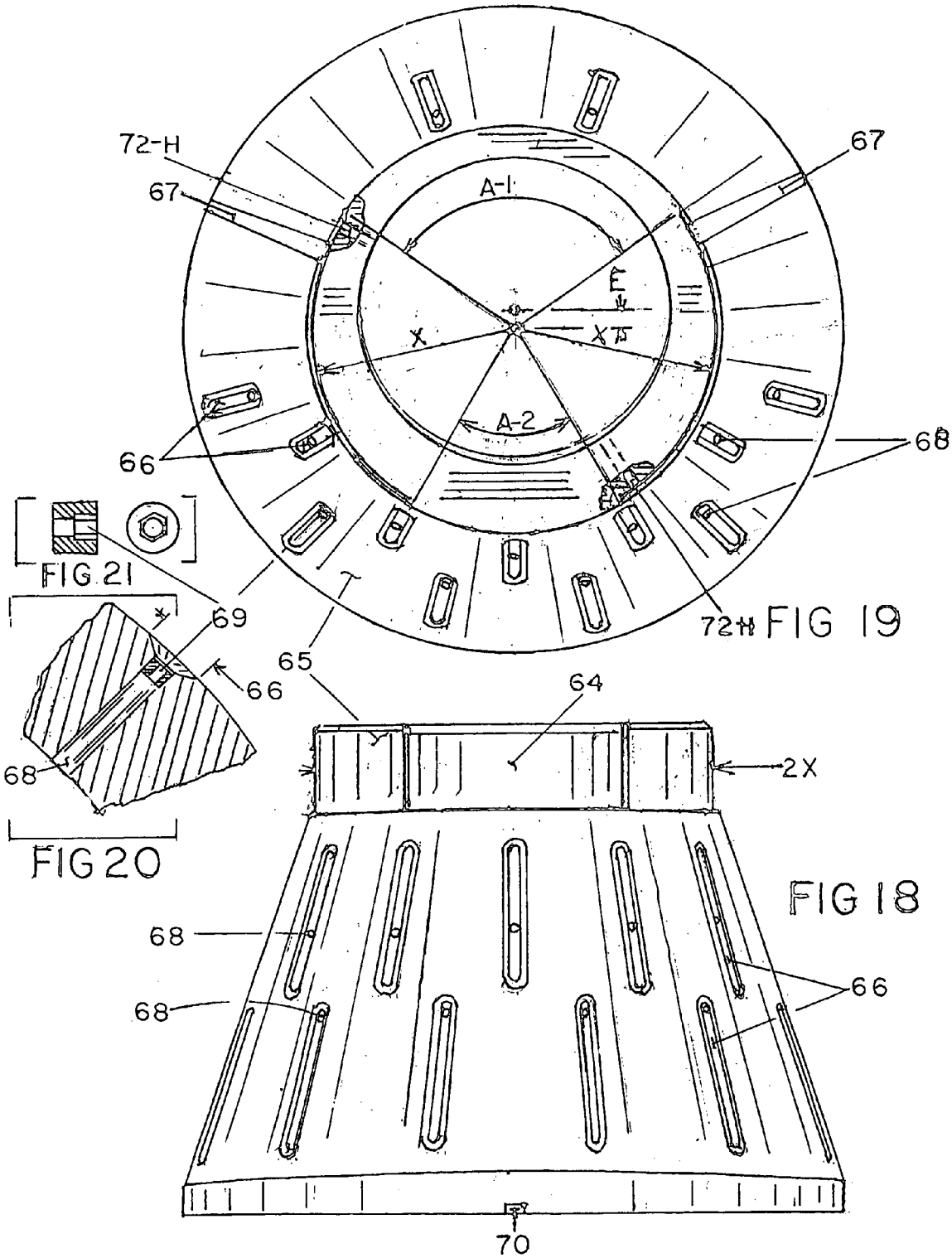
FIG. 18 is a vertical view of 65 a conical eccentric member; 66 are flutes with tapered edges; 68 are oil holes with tapered threads at outer ends; 70 is a keyway; 2X is the diameter between A-1 and A-2 arcs, FIG. 19.
FIG. 19 is a plan view; 67 are slots open at the large end of the taper of 65; A-1 is an arc of less than 180°; A-2 is a smaller arc than A-1; X are radii between said arcs and of shorter radius than said arcs.
FIG. 20 is an enlarged view of 68.
FIG. 21 is an enlarged view of nozzles 69.
Figure 29:
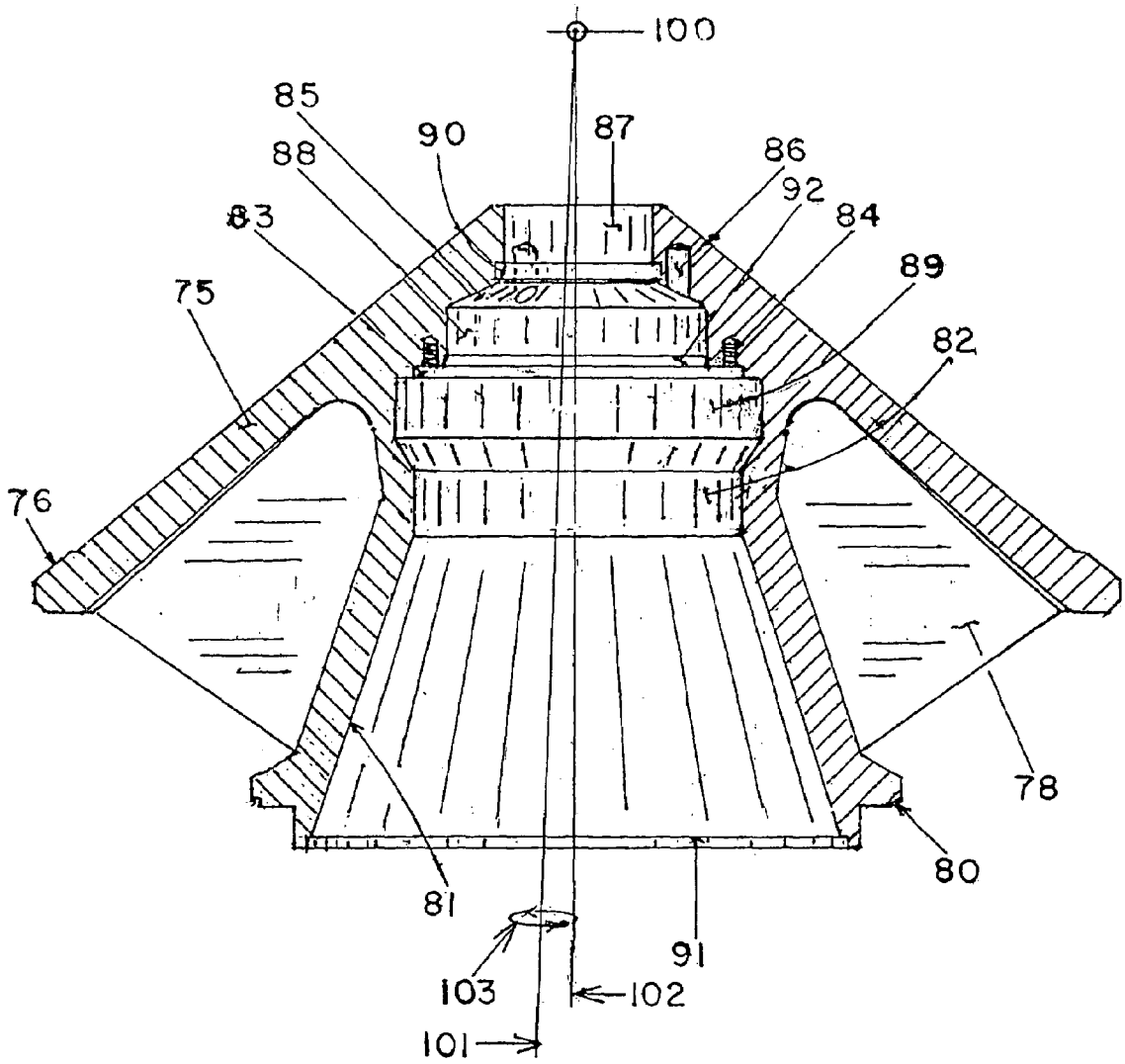
FIG. 29 is a vertical section view of cone head 75; 100 is the apex of center lines 101 and 102; 103 is the amplitude of gyration; 81 is a converging conical bearing surface; 82 is a cylindrical bearing surface; 89 is gyrating clearance; 83 is a precision recess with threaded holes 84 in its face; 92 is a conical surface; 88 is a smooth precision cylindrical bore; 85 is a conical surface; 86 are precision spaced blind holes; 90 is an annular seal ring groove; 91 is an extended cylindrical section.

FIG. 18 show a vertical exterior view of the eccentric member 65 which is a non-ferrous bearing quality casting; the taper of outer conical surface FIG. 18 is an exact match to the taper 81 of cone head member 75 FIG. 29; 64 is a cylinderical extension having two spaced apart bearing arcs, A-1 and A-2 and in between arcs of X radius. Because it is not possible to use flow dividers to control oil flow to the outer bearing surface, we use exchangeable nozzles 69 FIGS. 19 & 20 and detailed in FIG. 21 to vary the hole sizes to force the oil volume as best served, the eccentric offset through 180°; said nozzles, usually pipe plugs drilled through, have tapered threads and are positioned at the exit of each hole 68 whose inner ends center on grooves 39; holes feeding lower flutes 66 rotate around the lower groove 39; upper flutes receive oil from the top groove 39; lube oil that ejects out of the top of the spindle and out of the thrust bearing 160 works again as it passes between the bearing surface of eccentric 65 and 81 of member 75; open ended valleys 67 drain lube oil to prevent pressure build-up in the space above the eccentric, because hydrostatic bearings must discharge lube oil into low or zero pressure conditions to perform as intended. The eccentric does not contain bushings; it is a one piece member and has four bearing surfaces, two conical and two cylindrical; FIG. 19, a plan view, has an inside diameter, 63 FIG. 22, with just enough diametral clearances for oil film and thermal contraction to rotate freely around extension 48 of spindle 38; outer bearing diameters of extension 64 have arc A-1 of less than 180° and a spaced apart arc A-2 that have minimal operating clearance co-acting with bearing surface 82 in FIG. 29; said arcs are equally centered to the plane of the eccentric; radii X form large arcs between arcs A-1 and A-2 and have substantially shorter radii which form very large clearances that can absorb excessive thermal expansion should it occur by bulging radially enough to eliminate clamping against surface 82 FIG. 29; the eccentric metal is flexible enough to allow said bulging without excessive bearing pressures on arcs A-1 and A-2. The conical angles of FIG. 18, and cone head, FIG. 29 are held concentric to their centerlines as is a spherical thrust bearing 106 to said spindle FIG. 30 and 160 FIG. 33.

Figure 22:
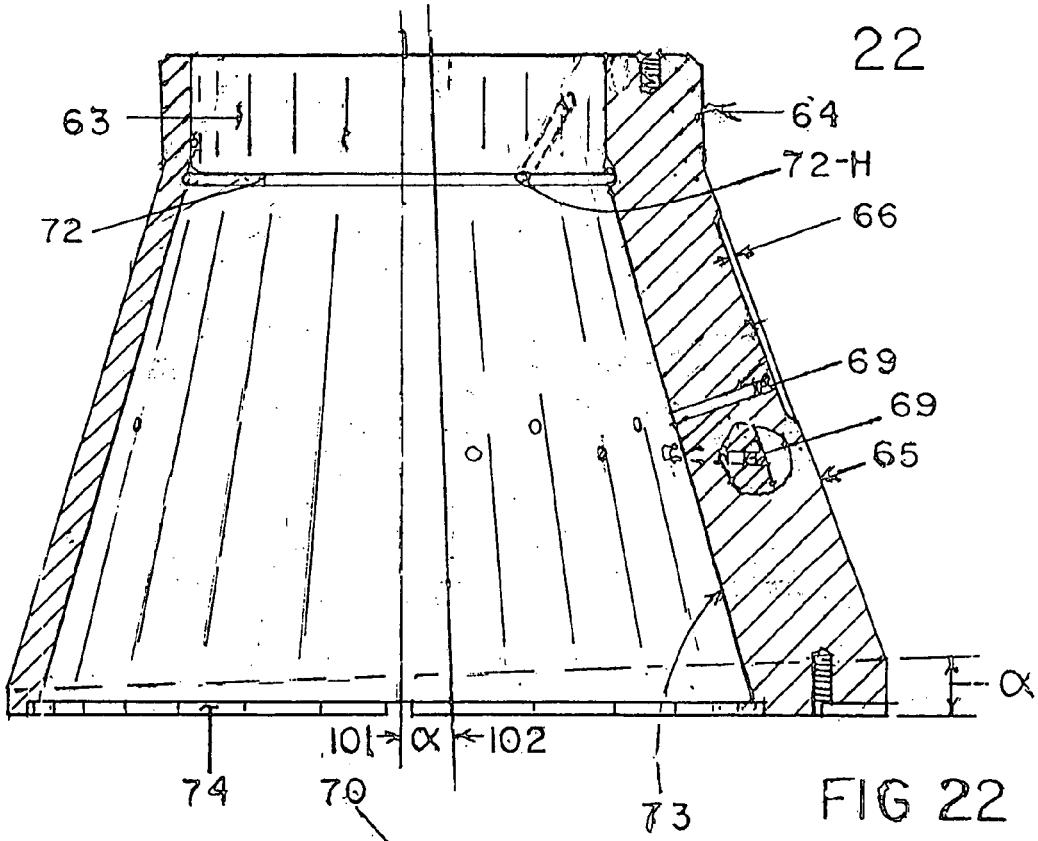
FIG. 22 is a vertical sectioned view through the plane of the eccentric 65; 64 is a cylindrical extension concentric to centerline 102; 63 is a cylindrical extension concentric to centerline 101; 72 is an annular groove; 72-H are oil vent holes; 69 are nozzles; 74 is a centering bore; 101 is the centerline of inner cone 73; 102 is centerline of outer cone of 65; angle $\alpha$ is established by 101 and 102.
Figure 23:
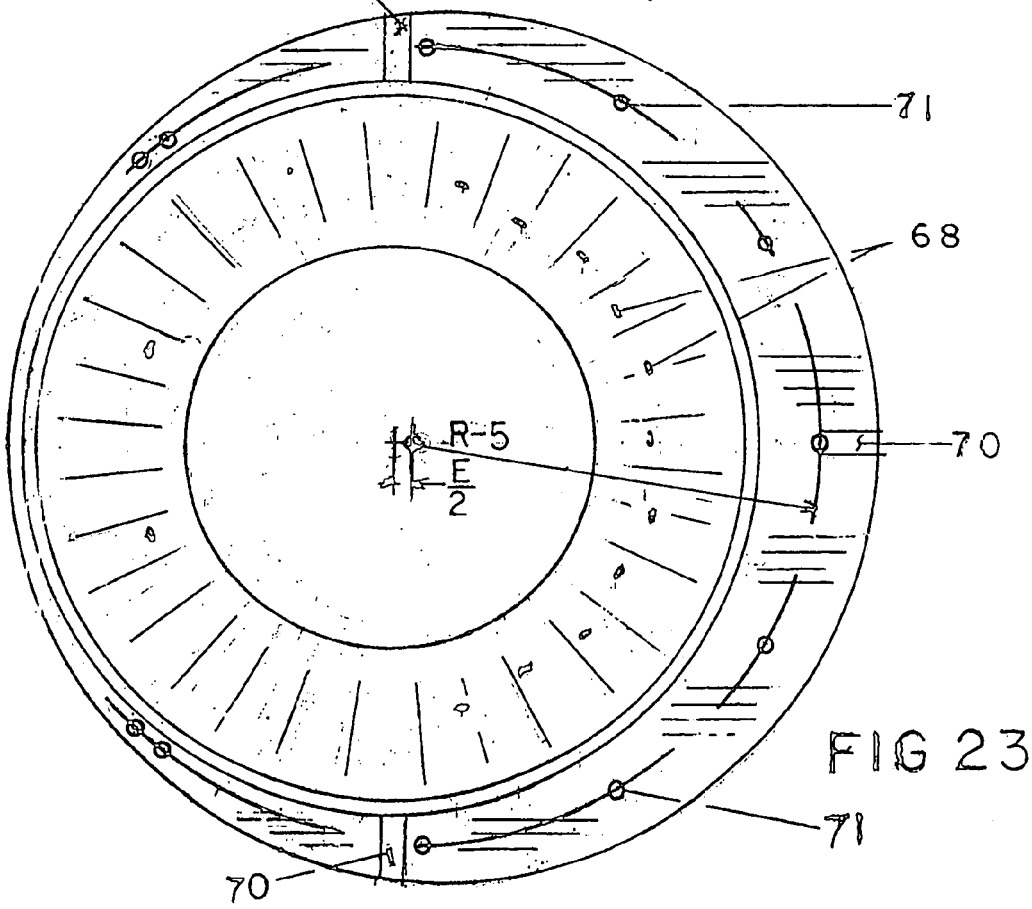
FIG. 23 is a plan view of the bottom; 70 are one or more keyway slots; 71 are multiple threaded holes on radius R-5.

FIG. 22 is a vertical section view 90° to the plane through the eccentric offset. 73 is the inner conical bearing surface that rotates about spindle member 38 concentric to centerline 101 as does cylinderical bore 63. 72 is a annular groove that accepts hydrostatic oil that escapes from the top of the taper 73 and funnels the oil outward through holes 72-H to prevent back pressure from the close fit of cylindrical bearing 63. Discharged oil exits just ahead of arcs A-1 and A-2 for additional lubrication. 102 is the centerline of the outer cone and bearing extension 64 and is canted by angle $\alpha$ which establishes the radius of gyration of cone-head 75. 66 is a profile view of a typical lubricating flute with a nozzle 69 in a hole 68 positioned to receive oil from the upper annular groove 39; the cutout section shows a 69 receiving oil from the lower 39. Keyways 70 and keys 77, FIGS. 24 and 25, transfer driving torque and accommodate thermal expansion and contraction without distorting eccentric member 65; cap screws holding 65 to an eccentric drive plate, 150 FIGS. 24 and 25, have sufficient clearances in holes 192 to accommodate differential thermal movements of said eccentric. 74 centers eccentric 65 on its drive plate 150. FIG. 23 is a bottom view showing the normal positions of keyways 70 and threaded holes on R-5 radius, also shown are holes 68 exiting the conical inner surface.

Figure 24:
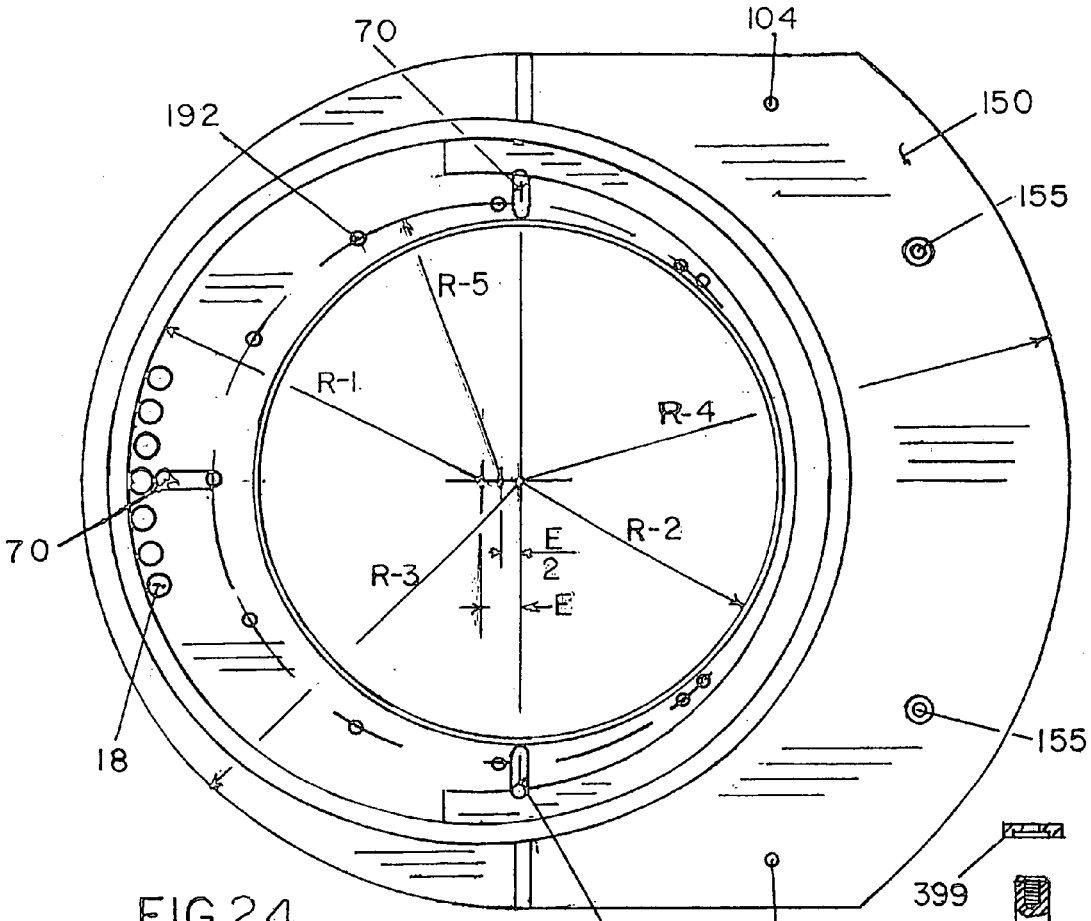
FIG. 24 is a plan view of the eccentric drive plate 150; $_{E}$is the eccentric offset and the center of radial line R-1; radii R-2, R-3, and R-4 are centered on the machine's center line 101; $_{E}$/2 is the center of R-5 bolt circle; 192 are cap screw holes on said bolt circle; 70 are keyways; 18 are multiple lube oil drains; 155 are up standing bars; 399 are counterweight clamps; 104 are threaded holes.
Figure 25:
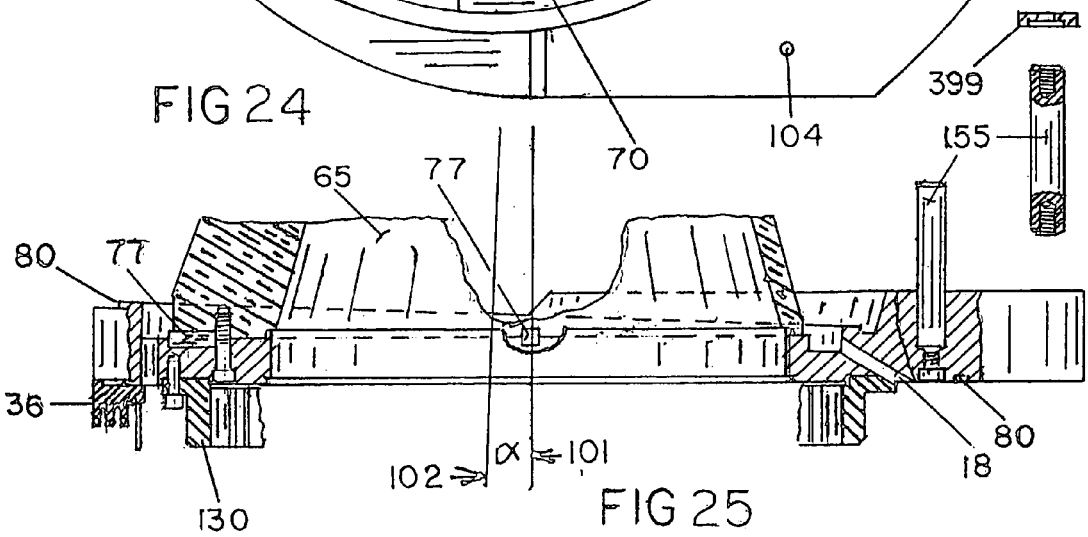
FIG. 25 is a vertical partially sectioned view showing eccentric 65 with drive keys 77, an internal tooth gear 130 bolted to 150, 155*s* embedded in 150 and retained by cap screws, and a section of a labyrinth seal ring 36. 80 are dust seal retaining bosses.

FIG. 24 is a plan view of the eccentric drive plate 150; it is attached to said eccentric 65 by cap screws in holes 192 drilled on R-5 radius and is driven by keys 77 FIG. 25; radii R-2, R-3, and R-4 are centered on the main centerline of the machine; R-1 is a varying radius from centerline 102 that reaches its maximum at the largest conical diameter of eccentric member 65 and diminishes to zero at apex 100; 104 are threaded holes for attaching counterweights; FIG. 25 is vertical sectioned view of member 150 showing partial assembly with 130 an internal tooth gear that drives the eccentric member; it is attached to the underside of 150 by multiple cap screws and is shouldered to run concentric to main centerline 101; a section of 36 a labyrinth dust seal seated against shoulder 80 is shown; it is concentric to 101. 18 are oil drains that flow lube oil back to a reservoir. The combined weights of the cone head 75, mantle 119 FIG. 27, and part of the eccentric establish a center of gravity that when gyrating eccentrically creates centripetal forces that must be neutralized; this is done by counterweighting; the extended R-4 radius provides about half the required counterweight, and most of the extra weight required is provided by weights 151 FIG. 3 and fine tuned by weights 152 (see FIG. 32) that can be changed without removing the cone head. Pins 155 embedded in holes with clamping washers

Figure 26:
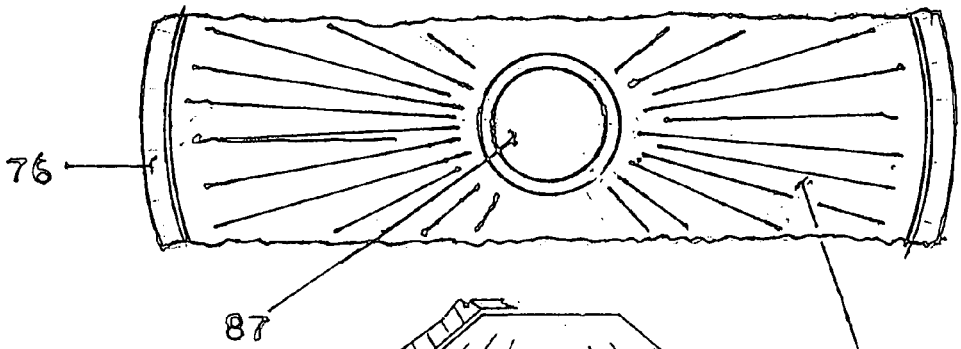
FIG. 26 is a plan view of a section of cone head 75.
Figure 27:
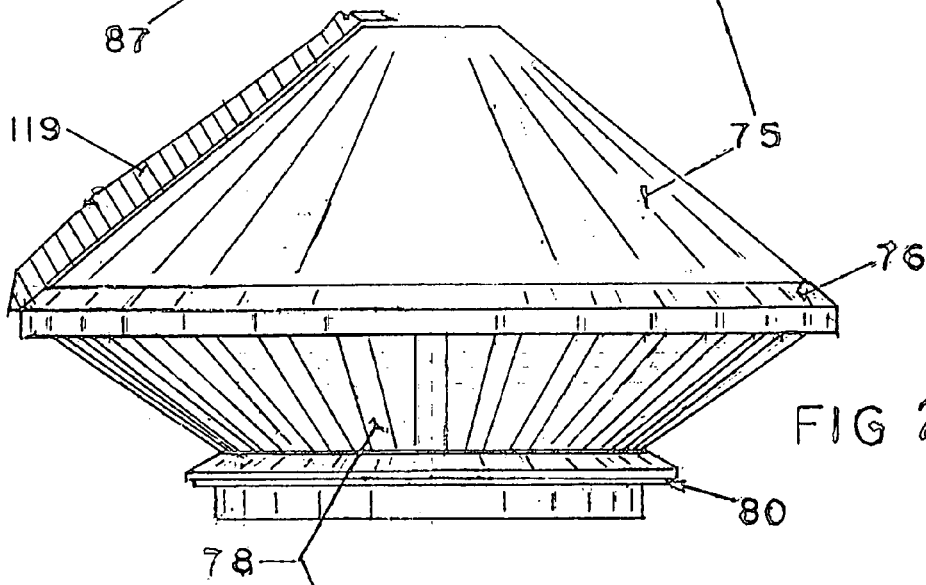
FIG. 27 is a vertical view of the exterior cone-head 75; 76 is a conical area raised above the conical surface of 75; 80 is a dust seal retaining boss; 119 is a sectioned view of a mantle (wear liner)
Figure 28:
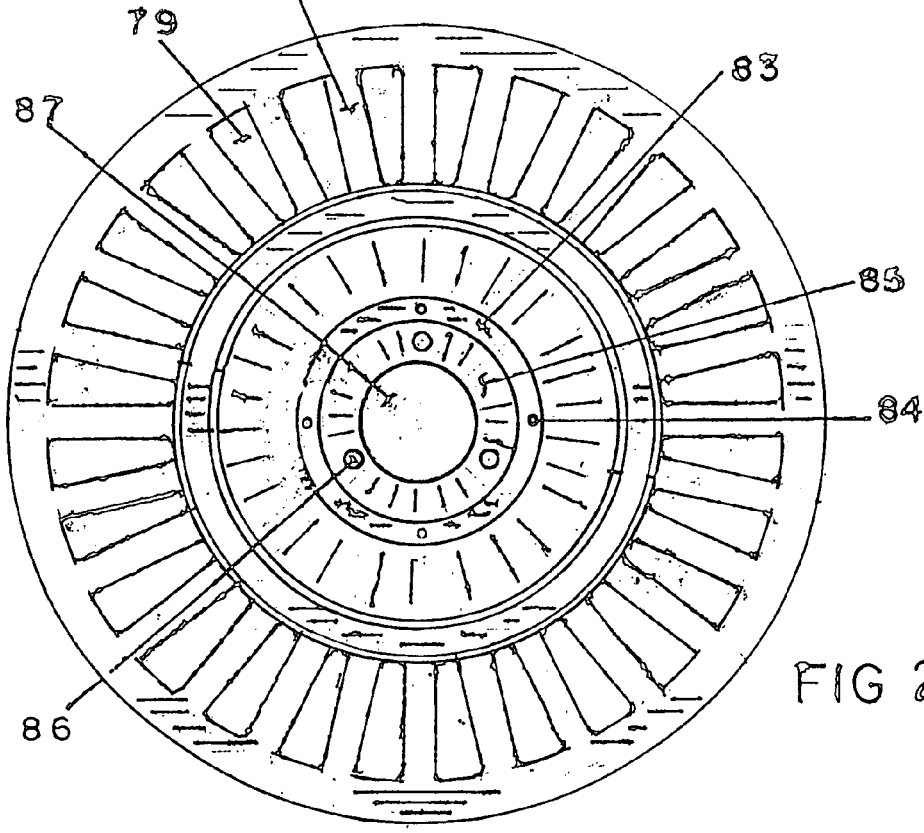
FIG. 28 is a plan view of the lower surfaces of 75; 78 are multiple struts; 79 are cavities; 83 is a flat surface; 85 is a conical surface; 86 are precision spaced holes; 87 is a precision bore.

399 plus long cap screws in threaded holes 72 hold all upper counterweights against centrifugal forces. The spinning counterweights generate considerable air turbulence within the open chamber below the cone head; circular shields, 336 FIG. 3, supported on upright members 9 FIGS. 4 and 5, direct air flow upward and downward rather than radial; this reduces rock dust erosion of the counterweights and directs some air flow into cavities 79 of said cone head member thereby producing some cooling effect to it. 80 is a positive angled boss to retain seal 36 by shrink fit FIG. 26 is a segmented plan view of the top of the cone head; FIG. 27 shows a vertical view of the exterior configuration of the cone head 75, this is the member that is gyrated by the eccentric and performs the crushing action; 119 is a wear mantle that is firmly clamped, detailed on FIG. 22, to said cone head and prevents wear on the cone head itself. Depending on the abrasive characteristics of the rock being crushed, the wear life of 119 can be from a few days to years. Because of the extreme difficulty to machine the wear material, usually manganese steel, we choose to employ a fairly narrow machined surface 76 to support the mantle at its rim this leaves a space inward that is filled with a liquid epoxy backing, FIG. 22, that hardens in a short time; 80 is a boss for retaining a sealing ring; FIG. 28 is a plan view of the bottom; 78 are struts that transfer crushing forces into the conical wall of bearing surface 81, FIG. 29; 79 are spaces between said struts to reduce weight, costs, and make easier to counterbalance; 84 are threaded holes to retain a conical thrust bearing; 86 are two or more holes evenly spaced in conical surface 85, we prefer using three, that lock a piston from rotating; 87 is a precision bore that serves as a cylinder.

FIG. 29 shows a vertical sectioned view of said cone head; 81 is an extremely accurate conical and smooth bearing surface that journals on the eccentric 65; 91 is an extension of the cone head that serves as an oil deflecter and a protection of surface 81; 82 is a smooth bore cylindrical bearing surface that co-acts with the eccentric's bearing surface 64 FIG. 22 to stabilize the conical hydrostatic bearing section below; 89 provides gyrating space around thrust bearing 160 FIG. 33; 83 is a precision recess to retain 106, FIG. 30 page 13, the convex half of thrust bearing 160; 92 is a short steep taper to assist the installation of a large elastomer seal ring; 88 is a smooth cylindrical bore in which a piston slides; 85 is a conical surface to match the top conical surface of a piston; 86 are clearance holes for pins 97 FIG. 30; 90 is a seal ring groove, and 87 is a smooth bore for a piston extension to slide.

FIG. 30 details the assembly and functions of parts that retain said mantle 119 and comprise one of the most important elements of our invention and claims. Piston 93 combines a mild steel disk having a steep tapered female buttress thread into which a very high strength steel cylindrical member 94 is assembled with an anaerobic sealant and tightened to refusal; 94 has an internal thread that accepts the male thread of cap screw 99 with a free fit; the wall thickness of 94 provides more tensile strength than 99 in case a breakage should occur; 94 has a valve assembly 110 threaded into the recessed face of its threaded bore; a hole 118 is angle drilled from above the first thread of its taper into the hole containing 110. Seals 95 and 96 provide leak proof retention of high viscosity oil that is pumped into the space between said seals. When installing a new mantle it is lifted by a crane or other means and preferably using our safe lift device (U.S. Pat. No. 5,323,976) and placed over and centered on cone head 75; said lifting device is removed, and conical washer 98 is positioned; large cap screw 99 having a double conical head is threaded into 94 and hand tightened with a pin wrench to pull piston to face to face contact of its angled surface. FIG. 31 is an enlarge sectioned view of 110; an oil pump extension 121 engages fitting 117 through a threaded hole in 99; pumped oil flows past ball valve 111 and out hollow hex screw 113; cap screw 116 is slightly loose until all air is ejected, then it is tightened forcing ball valve 114 to be firmly seated; oil is then pumped into 117 until the piston is pulling between 200K and 800K lb.s depending on the size of the crusher; these forces are easily obtained with our new system but extremely difficult with sledging against a wrench to turn the screw or nut as in all other designs. Epoxy backing 120 is poured through holes cast near the top of the mantle During crushing the mantles on every kind of gyrating crushers tend expand due to pressures of crushing; this phenomenon causes the mantle to creep relative to its cone head in the direction the cone head gyrates; this results in the cap screw or nut, whichever is used, becoming so tight that it is impossible to unscrew; the hand of the threads are determined by the direction the cone-head gyrates at time of manufacture of the machine, so that it will continue to tighten, if the threads were the other hand the mantle would loosen which could have disastrous results, consequently a cutting torch is necessary to relieve the enormous pressure and friction; either a torch ring is used, or the washer is cut, which then another must be purchased, or the mantle is cut with an arc-air electrode because manganese steel cannot be cut with gas torches; these are time consuming and costly methods that have been and still are unavoidable until now. To prevent the piston from turning with its cap screw in our new concept we use pins 97 pressed into the piston and engaging clearance holes 86; when mantle changing time comes, wear cap 122 that has been held in place by a cap screw 333 is removed, and a small socket wrench on an extension handle opens screw 116; oil pressure is releaved through port 115; the cap screw 99 can be unscrewed with a hand wrench; the work is easy; the time is fast, and nothing has been destroyed. However, nothing mechanical is fool proof, and should the hydraulic oil escape from its containment the cap screw will draw the piston tightly against surface 85; in that event washer 98 can serve as a torch ring; copper washer 105 prevents a cutting torch flame from damaging the surface of the cone head, because copper can't be cut by a cutting torch. Nut 334 was left in place at time of assembly to enable our safe lifting device to be reattached and used to lift off the worn mantle; a setscrew that was threaded into said nut at the time of installing a new mantle to protect the nut from filling with epoxy and later by rock dust must be removed first. Other members of FIG. 30 are thrust bearing 106 having a case hardened and polished spherical surface on a radius centered at apex 100 and is retained in recess 83 by cap screws 107. A universal joint 108 in a recess is held by cap screws; 109 is one half of a jaw clutch fastened to said joint 108; its conical projection is to guide said clutch into its mating half which is a blind assembly in an inaccessible position; these are parts of a cone-head anti-spin device FIGS. 33 and 34.

Figure 32:
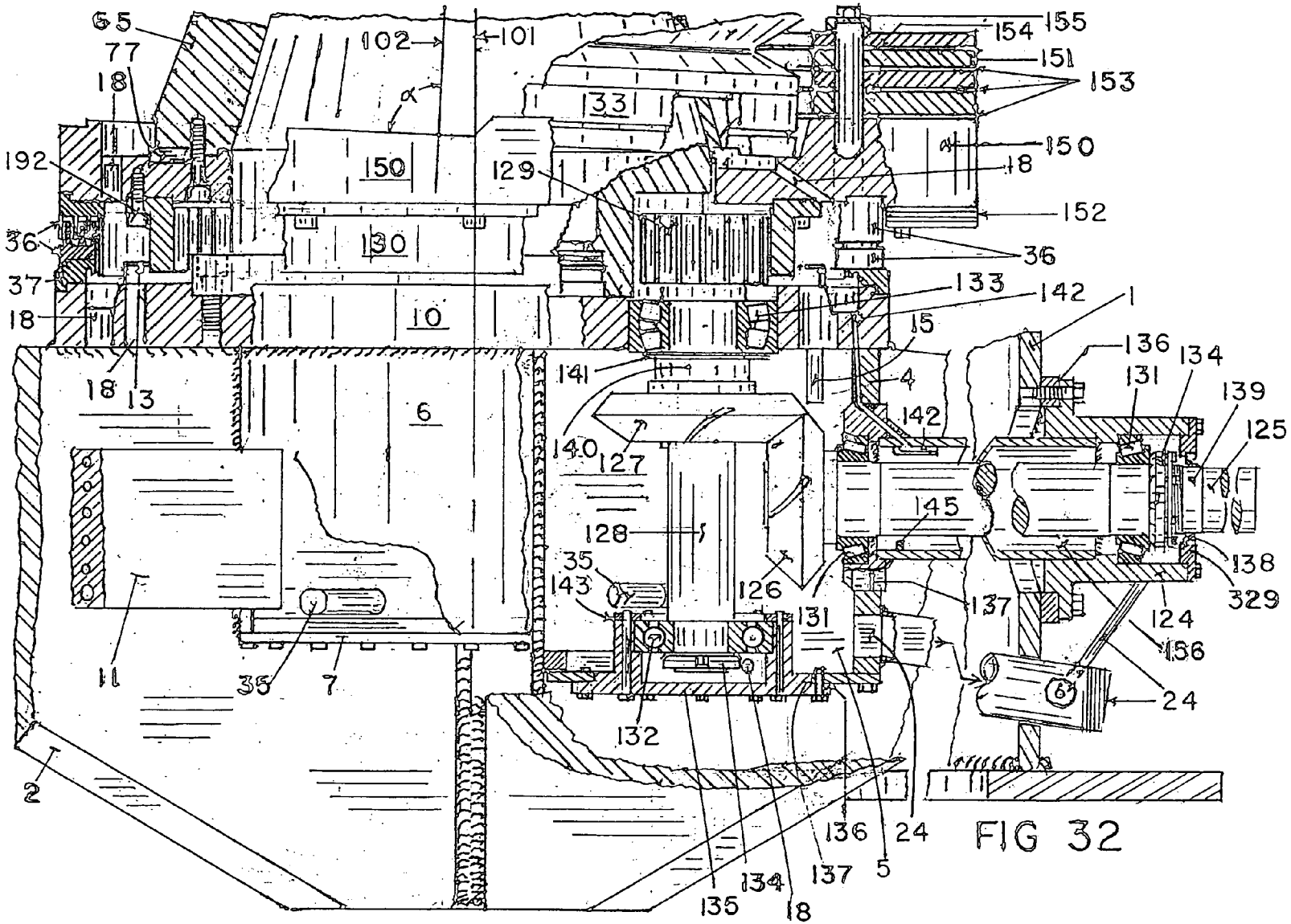
FIG. 32 is a vertical section view through the drive train gearing; 124 is a bearing housing extension of shaft enclosure 156; 125 is an input shaft journaled in bearings 131; 134 is a bearing adjustment mechanism; 138 is a sealing member; 139 is a wear sleeve; 329 is a closure cover; 136 are shims at two places; 137 is a seal ring; 145 is a dike; 126 is a spiral bevel pinion gear; 127 is a mating spiral bevel gear (both too difficult to draw the teeth); 128 is a vertical gear shaft; 129 is a spur gear; 130 is an internal tooth gear; 192 are gear and eccentric retaining cap screws; 133 is a roller bearing; 140 is a spacer; 141 is a spacer oil slinger; 132 is a ball bearing; 134 is a retaining nut and locking washer; 135 is a bearing housing; 143 is a bearing retainer plate; 142 is an oil passage way; 24 are oil drains to a reservoir not shown; 36 are dust seals; 37 is a seal ring spacer; 151 are counterweights; 153 are spaces between counterweights; 154 are spacers; 152 are fine tuning balancing weights.

FIG. 32 shows vertical sectioned layout of our double reduction gear train; 125 is the powered input pinion shaft; it is journalled in tapered roller bearings 131 in tubular housing 156; 134 is mechanism to adjust said bearings to correct operating clearance; 138 is a sealing means against entry of contaminants and escape of lube oil; 139 is a replacible wear band to protect the shaft from a rubbing seal; 329 is a cover plate retaining said seal; 126 is a spiral bevel pinion gear keyed and shrunk fit to said shaft; 137 is elastomer seal ring to seal against oil loss; 142 is a passage way in combination with dike 145 to deliver lube oil to outer bearing 131; a small drain tube drains this oil to main oil drain 24; 136 are shims for adjusting pinion gear mesh with mating gear 127; 128 is a vertical shaft with spur gear 129 preferably made integral but could be a separate gear keyed and shrunk fitted to shaft 128; roller bearing 133, flinger 141, and spacer collar 140 position gear 127 to an exact position from gear 129 and ball bearing 132; by positioning bevel gear 127 above bevel pinion gear 126 the torque pressure on 127 and counter torque on spur gear 129 greatly reduces the loading on bearings 133 and 132; the radial loading on inner bearing 131 adjacent to gear 126 would be the same regardless of rotation direction; bearing 132 is capable of handling thrust loads in either direction as well as radial loads; it is retained in fixed position in housing 135 by retaining plate 143 and cap screws; lock washer and nut 134 hold 132 firmly against the shoulder of shaft 128; 136 are adjusting shims for gear 127 meshing with 126; both gears require meshing adjustability; this system insures obtaining and maintaining proper bevel gear meshing; spur gear 129 does not require meshing adjustment; gear 130 is attached to eccentric drive plate 150 which in turn is attached to eccentric 65 as previously shown in FIG. 25; when lube oil enters between said eccentric and spindle 38, the eccentric assembly lifts to a level that balances the oil escape rate to the weight of the assembly; oil viscosity is also a factor; when the pressures of crushing begin, the assembly is forced down to a thin oil film; total variations of vertical movement between running empty to maximum loading may reach two millimeters; straight tooth gears accommodate these variations; any radial runout is accomodated by extra depth cut into these gears. FIG. 32 also shows labyrinth seals 36, seal spacer 37, counterweights 151, air spaces 153 for rock dust to escape thereby minimizing dust from build-up on the inside surfaces of the weights, spacers 154, and fine tuning balancing weights 152. A very important advantage of this design is its elimination of the massive gear well of other cone crushers and permits the use of full depth crossbeams for greater strength with a substantial reduction in weight and costs, especially so because structural steel is about 30% the cost of cast steel and much less subject to flaws. 18 are oil drains; 35 are drain ports in beams 2.

Figures 33, 34:
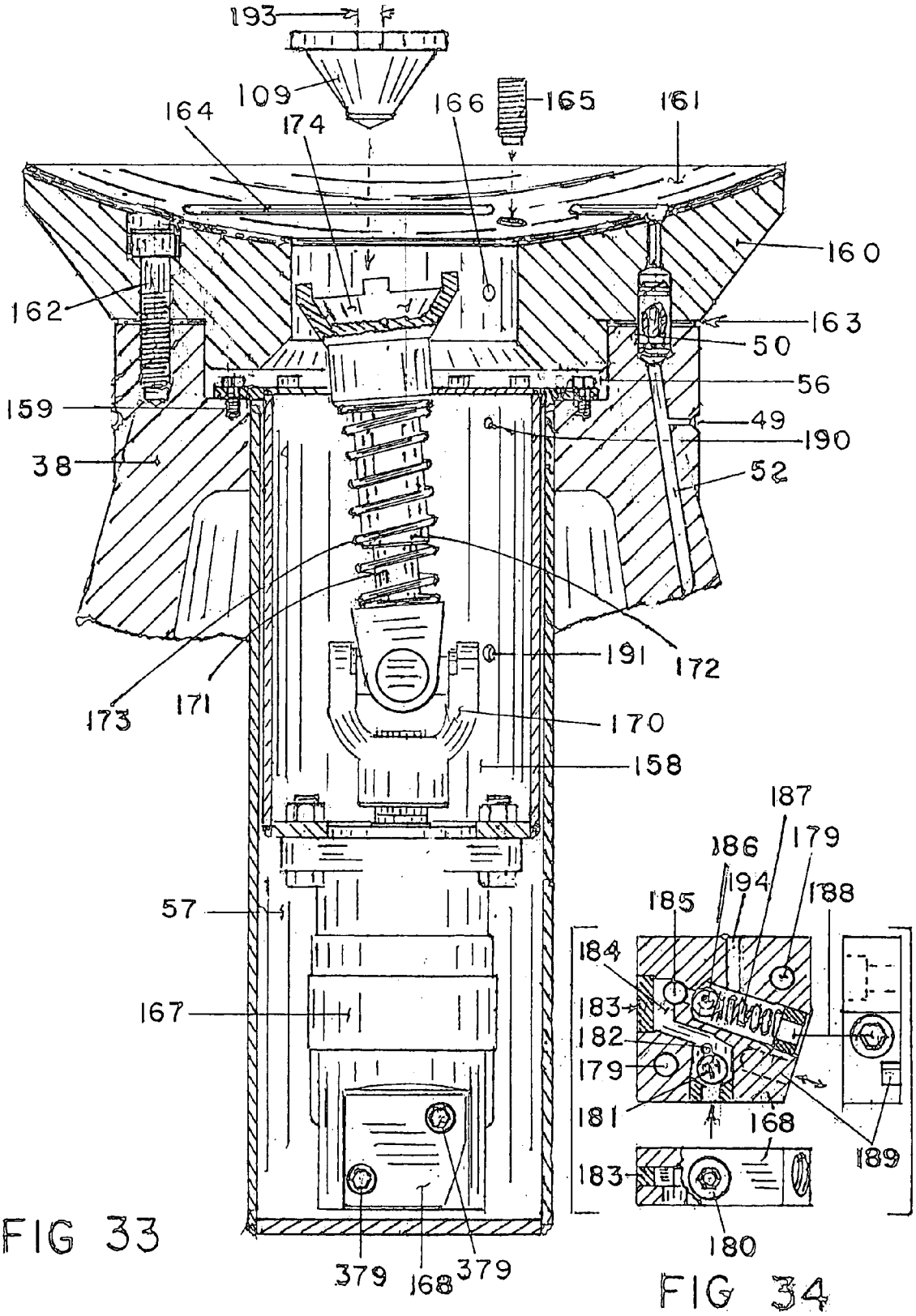
FIG. 33 is a vertical section view of thrust bearing member 160 mounted on spindle 38; 161 is a bearing quality metal bonded to 160; 163 are adjustment shims; 162 are retaining cap screws; 164 are arcuated closed end galleries machined into 161; 165 are jacking screws; 50 are lube oil transfer nipples; 174 is the female half of jaw clutch 109; 158 is a tubular motor mount; 159 are cap screws; 167 is a hydraulic motor; 168 is a valving member; 379 are cap screws; 170 is a universal joint; 171 is a male spline shaft; 172 is a female spline; 173 is a coil spring; 191 is a port opening in 158; 190 is a vent opening in 158; 166 is a pressure relief vent in 160.
FIG. 34 is a cut away view of 168; 180 is a valve seat; 181 is a ball; 179 are bolt holes; 182 is stop pin; 183 is a closure of a machining access; 184 is an oil passage way; 185 is a hole; 186 is a ball; 187 is a coil spring; 188 is a pressure adjusting screw; 189 is a two way oil flow passage; 194 is an optional venting port.

FIG. 33 is a vertical sectioned view of the thrust bearing 160 and cone head braking mechanism; 161 is a bearing quality over-lay of bronze welded to steel member 160; however, such over-lay could be other bearing quality metals e.g. Babbitt or hard plastics. 164 are radial lube oil grooves spaced apart by closed ends and are supplied with oil by tubes 50 with sealing rings which transfer hydrostatic lube oil across a shimming gap between spindle 38 and member 160; cap screws 162 pull member 160 into a tight fit in recess 56 and to hold same; jack screws 165 are used in adjusting shims 163 and to extract 160. The thrust bearing is positioned vertically to support the cone head a predetermined distance above the eccentric; this distance is the sum of the sines of the desired oil film thickness of the spindle angle and the outer angle of the eccentric. The lubrication of the cone head conical surface 81 is mostly hydrodynamic, but is assisted with some hydrostatic lift. When cone crushers are running idle (not crushing), the cone head will tend to spin with the eccentric because of frictional drag; this is undesirable; Louis Johnson, co-patentee of this application, invented the first head brake for cone crushers, U.S. Pat. No. 3,207,449, in which he used an over-running clutch, and which others have copied; the problem with such clutches is they cannot endure shock reversing impact nor torque loads above their capacity; when this happens they rupture or shearing devices are used to prevent rupture; such clutches are expensive to buy and more costly to replace. Our new concept uses a hydraulic motor 167 with a valving mechanism that permits free turning in one direction but resist turning in the opposite direction; an enlarged view of the valve FIG. 34 details its operation; when crushing the cone head turns slowly retrograde to the eccentric and must not be restrained. To allow turning freely oil is drawn in through valve seat 180 and around ball valve 181; a stop pin 182 limits the travel of 181; oil flows through passage way 184 and into the motor through port 185 and out the motor through port 189, but when bearing friction tends to turn the cone-head with the eccentric oil is then drawn in through port 189, and ball valve 181 closes; for oil to escape it must force ball valve 186 to open which compresses spring 187; bypassed oil can be vented through hole 194 or through hollow hex screw 188 which is drilled to exhaust oil; the screw adjusts the spring force to just enough resistance to override head drag, but not enough to permit harm to co-operative parts if somehow the cone head adheres to the eccentric; to machine passage way 184 it is necessary to have an opening which is closed later with weldment 183; cap screws 379 hold valve body 168 oil tight to motor's porting face. At assembly of cone head to the thrust bearing and eccentric which is a blind assembling procedure, jaw clutch cone 109 automatically finds alignment to female cone 174 and slides into it, but it is unlikely that the projecting lugs of 174 will find slots 193 in cone 109 initially in which case spring 173 yields and spline 172 slides on 171 as needed; after the cone head is fully in place, and the lube oil pump is started, the head is easily turned by hand in the drag direction, thereby finding alignment where spring 173 will push the jaw clutch to full engagement; the universal joints convert eccentric rotation to inline rotation; The motor is suspended by tubular member 158 which is torque restrained by cap screws 159; fluid tight enclosure 57 prevents intrusion of heating/cooling fluid; lube oil escaping inward from said thrust bearing 160 fills the enclosure 57 and motor mount 158 through port 191 to the level of port 166; any air in the enclosure vents out hole 190 and 166; any excessive pressure is relieved through hole 166 and valleys 67.

Figure 35:
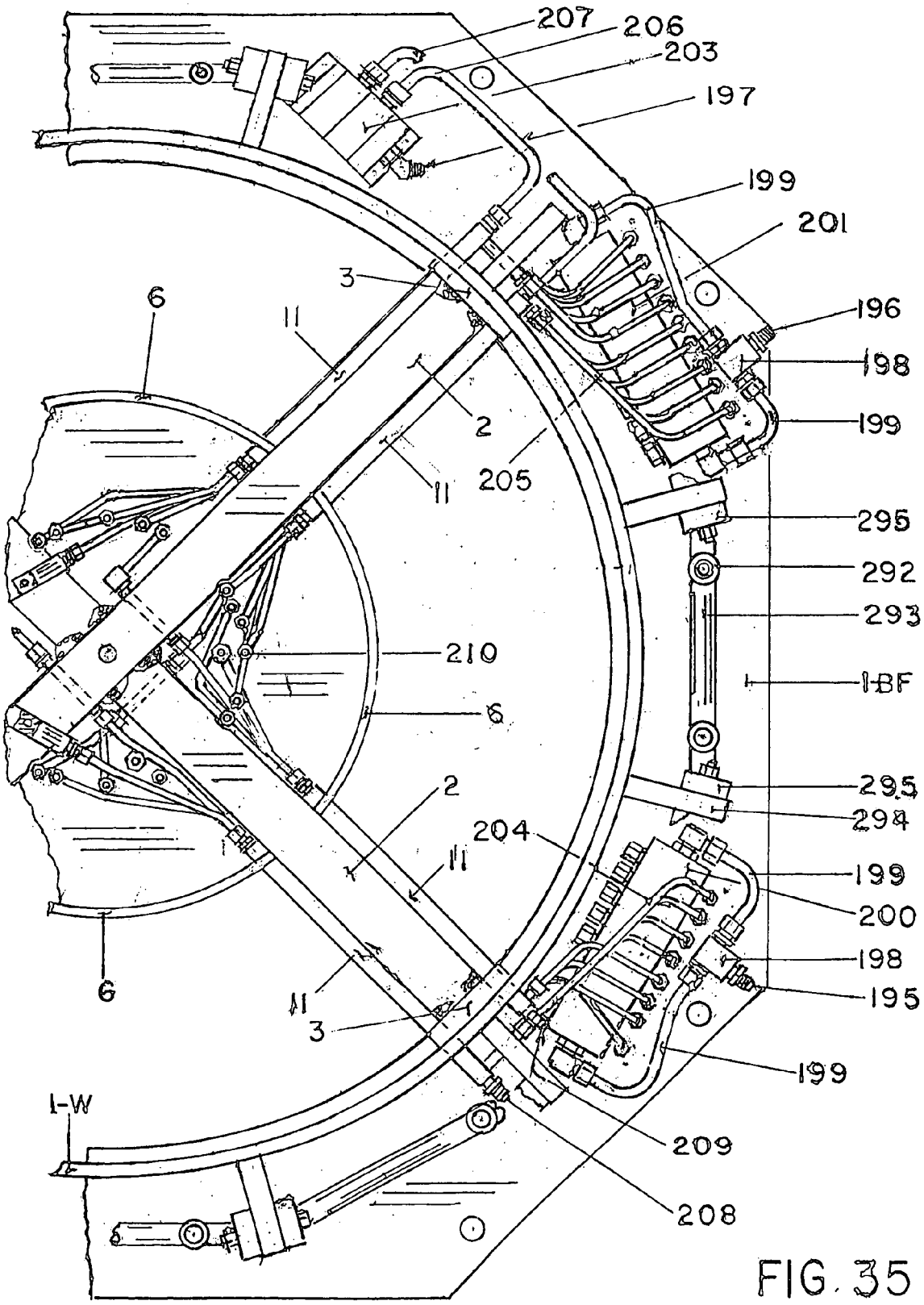
FIG. 35 is a plan view of our hydrostatic lubrication system and heating/cooling fluid connections; 200 and 201 are flow dividers; 203 is a flow proportionator; 195, 196, and 197 are connectors to hydraulic hoses from a pump source; 198 are $_{T}$fittings; 199 are lube oil tubes from 198 to flow dividers; 204 and 205 are multiple lube oil tubes to members 11; 210 are distribution tubes to specific connections; 207 and 206 are larger tubes with different flow volumes; 208 and 209 are heating/cooling fluid connectors; 292, 293, and 295 are detailed on FIG. 42.

FIG. 35 shows how the lube oil flows in our hydrostatic design; 200 is a flow divider that apportions oil equally to the flutes 42 in the lower zone of spindle 38; said oil flows out of 200 into tubes 204, into members 11 on each side of beam 2, and into three chambers formed by members 6, 10, and 20; members 11 are flat bars of steel of ample sizes to protect oil passage ways drilled through them from the ravages of falling rock; wear caps 335, FIG. 3, further protect members 11 and beams 2. Flow divider 201 equally apportions oil to the upper zone of said spindle and also to the thrust bearing 160 through lines 205; proportionator 203 ratios the oil to annular grooves 39 through lines 206, and 207; both lines deliver their oil to their pair of members 11; the lower groove gets the larger portion of oil from 203 because it supplies a larger bearing area; multiple lines within said chambers conduct their portions to specific connections in member 10; return oil drains through holes 18 in 10 into all four chambers, then through ports 35 in beams 2 and out exit port 24 to a tank not shown; lube oil drawn from said tank passes through filters and heat exchangers before reentering the machine; a three chambered pump supplies oil to connectors 195, 196, and 197. Heating/coolant fluid normally water and antifreeze mix enters through 208 and out 209 after circulating within chamber 61; said fluid also passes through heat exchangers as it circulates through the system. Numbers 292, 293, 295 are members of the safety relief system.

Figures 36, 37, 38:
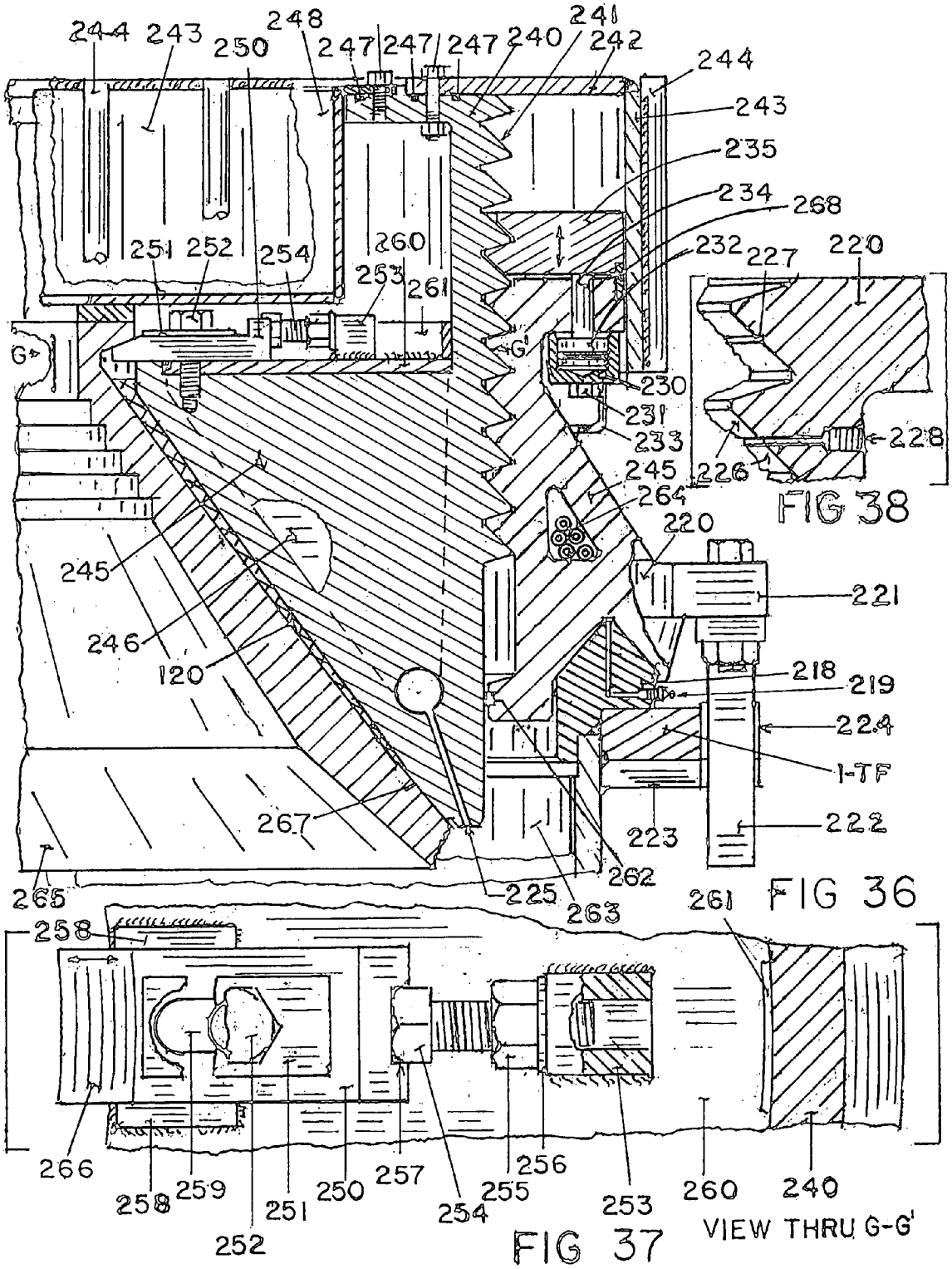
FIG. 36 is a vertical section view of the top frame assembly 1-BA; 220 is a bowl nut; 240 is a bowl; 221 are platform extensions of 220; 218 is an annular $_{V}$-ring pressed into the main frame 1-MF; 219 is one of several grease fittings; 222 is a depending arm; 223 is a platform welded to main frame; 224 is a stop block; 225 is a drain hole; 263 is a wear liner; 120 is backing; 246 are cavities between struts 245; 260 are cover plates welded over said cavities; 241 is modified thread form; 242 and 243 form an adjustment ring; 244 are equally spaced lugs welded to 243; 235 is a locking nut; 234 are thrust rods; 232 are pistons; 230 are cylinders; 231 are cylinder retaining cap screws; 233 are hydraulic lines joining cylinders 230; 245 are gussets forming openings 264; 268 is a depending band joined to 235; 247 are elastomer dust and moisture seals; 248 is a hopper for 250; 265 is a bowl wear liner.
FIG. 37 is an enlarge section of female thread 226; 227 is a small annular groove cut in the thrust flank of 226; 228 are multiple lubrication holes into 227 and having threads for fittings.
FIG. 38 is an enlarged plan view taken through G–G'; 250 is a slidable wedge; 253 is a thrust absorbing member; 251 is a cover washer; 254 is a bolt; 255 is a nut; 256 is a washer; 252 is a clamping cap screw; 259 is an elongated slot; 257 is a vertical slot in 250; 258 are guides; 266 is a wedging ramp with a conical radius; 261 is a 360° dike.

FIG. 36, A machine that crushes rock by compression has a stationary member and a moving member to form a squeezing force; in a cone crusher the stationary member is called a bowl which in this patent application is number 240; multiple gussets 245 brace the conical wall of 240; 246 are open spaces between said gussets. To protect the bowl from wear a bowl liner 265, a casting of wear resistant metal, is positioned in the bowl where it seats on conical surface 267; to retain it in place, we have designed a sliding wedging system using three or more wedges 250 evenly spaced circumferentially and to bear against an inverted conical flange machined at the top of said liner; FIG. 37 is a plan view through section G–G' that details their construction: thrust bolts 254 are locked from turning by vertical slots 257 as thrust wedges 250 are forced inward as nuts 255 are turned; blocks 253 absorbs the thrust, and washers 256 protect 253 from wear of turning said nuts; cap screws 252 and cover plates 251 prevent wedges from tipping and are tightened after all wedges are tight; slots 259 provide travel of wedges relative to cap screws; rectangular plate washers 251 are constructed to always cover said slots to prevent debris from entering slots; 258 are guides to prevent skewing of wedges; 266 is a wedging ramp with a conical radius to match liner's. When changing liners the bowl assembly is removed from the base frame as previously explained; the hopper is unbolted and lifted out by a crane; nuts 255 are turned toward the bolt heads far enough for wedges 250 to clear the liner's flange at the same time cap screws 252 are slightly loosened; if necessary the wedges are tapped outward; the worn liner drops out, and the bowl assembly is lifted and placed over a new liner, and the liner is lifted into place, and all wedges are slid under the liner's flange; then each wedge is forced inward in a manner to center the liner and then tighten the wedges securely; cap screws 252 are tightened. A backing material 120 usually epoxy, but could be molten zinc, is poured in its liquid state but soon turns solid. Not shown are pouring spouts built in to save workmen from making them every time new liners are installed. This design eliminates the time and expense of caulking places where liquid backing could leak, a problem with most other cone crushers. Hopper 248 is replaced and the bowl assembly is ready to install in the main frame; a process that is just as quick and easy as it was to remove, about twenty minutes, as compared to several man hours with other cone crushers. The hopper keeps rock away from damaging wedging system members.

A crusher must have a means of adjusting for whatever size product maybe required and to compensate for wear of liners; Most gyrating cone crushers use a threaded means to achieve that; a problem with threads is potential galling between two similar metals especially so if adjusting while still crushing; to cope with this problem we provide a small groove on the loaded face of the female thread, 227 FIG. 38, in the bowl nut 220 and a means of injecting special greases either by hand pumps or automatic lubricators through multiple places 228; the start and end of said groove are blocked as well as intermittently between said 228*s*; this is to prevent grease from escaping endwise and to obtain some hydrostatic separation. A lock nut 235 is restrained from turning by means of three equally spaced pins, 330 FIG. 3, but can move vertical a short distance; after an adjustment is made, hydraulic fluid under pressure forces multiple pistons 232 against thrust rods 234 which causes said lock nut to lift bowl 240 and hold it firmly against thread flank 226; all cylinders are connected in series by tubes or hoses 233; said pressure is maintained between adjustments by a P.O. check valve at the control console not shown. An adjustment ring 243 is bolted to the top flange of bowl 220, and it has vertical lugs 244 evenly spaced around its perimeter to engage pawls of the adjusting system, FIGS. 45 and 46 detail the power adjusting system. V-ring 218 has a means of receiving injected grease 219 to minimize fretting between it and bowl nut 220. 263 is a replacible abrasion resistant liner bolted to the inside of wall 1-W to protect said wall from erosion of the crushed rock; it is made in sections to facilitate replacing. 245 are bracing gussets with openings 264; hydraulic hoses for the adjusting means can be passed through these openings for neater appearance. 222 and 224 are shown edge on. 262 is an elastomer dust excluder. Hole 225 drains any rain water that might leak into chambers 246.

Figure 39:
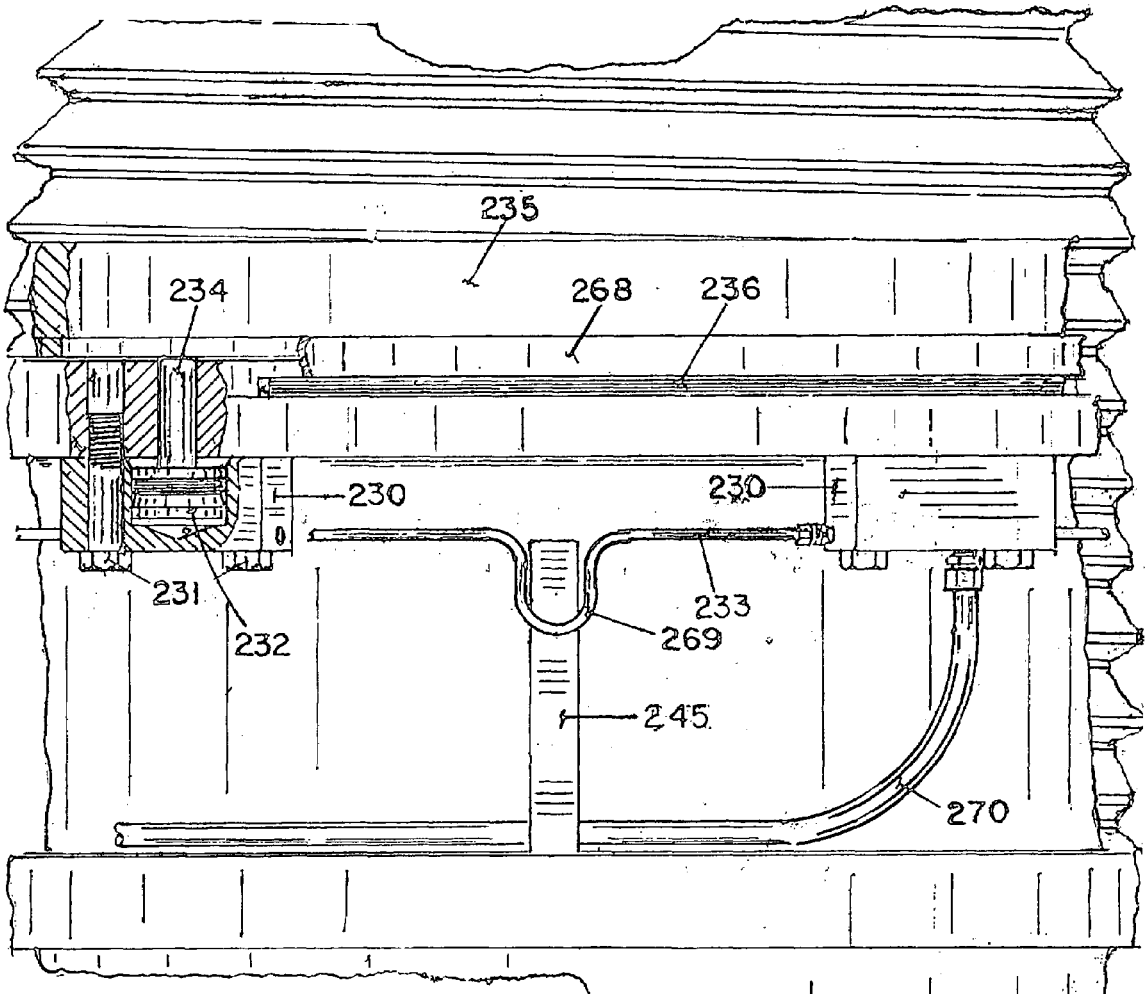
FIG. 39 is an enlarged vertical view of part of the top frame 1-BA; 235 a locking nut; 268 is a metal band; 236 is an elastomer seal; 230 is a partially sectioned hydraulic cylinder; 231 are cap screws; 232 are pistons; 245 are gussets; 233 are connecting tubes or hoses; 269 is an expansion/contraction configuration for tubes; 270 is a hydraulic hose from a power source.
Figure 40:
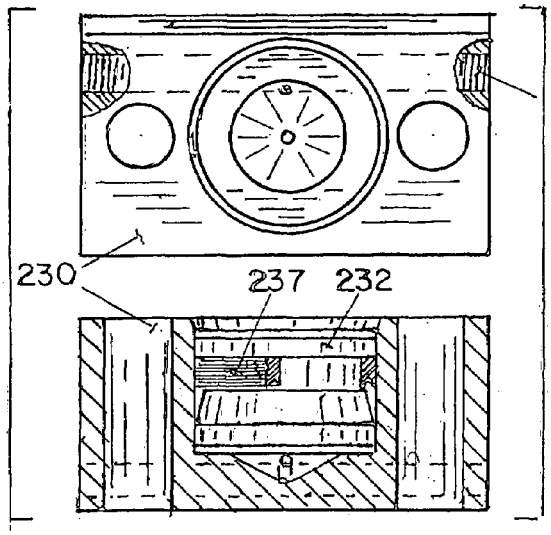
FIG. 40 is an enlarged plan and vertical section view of multiple cylinders 230; 237 is an elastomer seal; 271 is an oil passage through 230 with a side hole into each cylinder chamber.

FIGS. 39 & 40 show in enlarged detail our bowl nut locking system; a gap between band 268 and a shoulder on the top flange of bowl nut 220 provides space for a dust excluder 236; multiple cylinders 230 are clamped to the underside of said flange by cap screws 231 that are sized to cope with whatever pressures are imposed on pistons 232; high pressure seals 237 retain pressurized oil, but if any leakage develops each cylinder is easily removed, seals replaced and re-attached; rectangular cylinder bodies are through drilled and threaded 271, to receive connector fittings, and all are connected in series by lines 233 either tubing or hoses; small holes from cylinder heads to holes 271 feed oil in or out of said cylinders; two hoses 270 approximately 180 deg. apart conduct hydraulic oil to and from all cylinders for balanced oil flow between a T connector and one hose to a control valve and a P.O. check valve in the control console.

Figure 43:
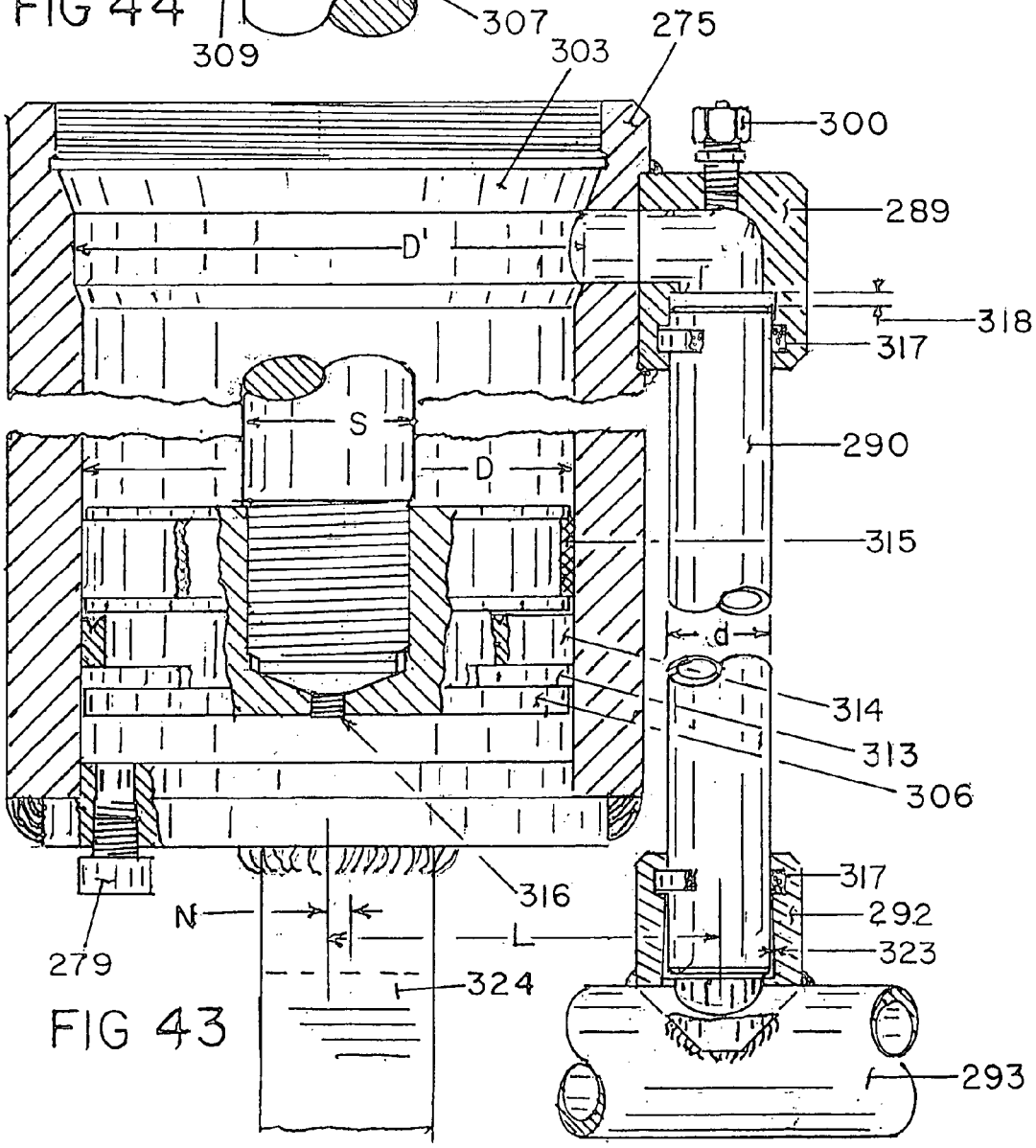
FIG. 43 is a sectioned view of a relief cylinder; 306 is a partially sectioned piston; 313 is a back-up ring; 314 is an elastomer seal; 315 is a non metallic band; 316 is a pipe plug; 307 is a piston rod of $_s$diameter; $_D$is cylinder diameter; $_D$' is a diameter larger than $_D$; 318 is a travel space; 317 are elastomer seals; 323 is a taper in 292 and 289; $_L$is the distance from the center line of 275 to the center line of 290; $_N$is an offset; 303 is a taper; 324 is an eye plate welded to 275.

FIGS. 41 & 42 and FIGS. 43 &44 combine to show our new concept relief system; FIG. 41 is a tangental vertical view of one of several assemblies; 294 is an anchor plate welded to 1-W and 1-BF that resists the pulling force of cylinder, 275; FIG. 3 shows it and 298 in full. Links 276 and pins 277 couple said cylinder to 294; 278 are retaining rings to keep pins 277 in place; 280 is a clevis joining piston rod 307 to hook like member 281; 282 is a concave disk centered on the line of tension and lightly welded to 281 by welds 288; 282 centers on convex disk 283 that has either a projection or a recess and pin that centers it on holes 284 all equal-distant from the center-line of the bowl nut 220 and are usually equally spaced circumferentially; block 286 contains a headless screw and rests on an inward projection of 281 and is held in place by a small bolt; a spherical head shoulder pin 285 is secured in the lower end of hole 284; screws in 286 are adjusted to barely touch 285; this system prevents hooks 281 from disengaging pads 283 when the system is not pressurized. When the system is pressurized, entrained air is bled out by valve 300, then all cylinders pull 220 downward onto V-ring 218 with great force. During normal rock crushing tight contact is maintained between 220 and 218, but should a non crushable object enter the crushing chamber the forces generated will lift the bowl assembly and override the gas pressures in the accumulators as oil flows from the cylinders 275 through tubes 290 and 293 and into the accumulators; this compresses the gas (Nitrogen) somewhat, but because of the large size accumulators we use, pressure increases are not excessive. This system prevents disastrous damage to the crusher. Louis Johnson, a co-applicant to this patent application, was granted a U.S. Pat. No. 3,118,623 for a similar but less sophisticated system. As explained earlier our new system allows the assembly to tilt outward on radius $_{\mathbf{R}}$or just the hooks on radius $_{\mathbf{r}}$; to do this blocks 286 are removed; valve 299 is opened to relieve pressure and hydraulic hoses with quick couplings are uncoupled; either a lever is placed under the projections supporting 286 and 281*s* are pried off of pads 283, or a special tool using hole 302 is used; all this can take less than ten minutes for two men; three lifting cables are attached to brackets 342 and to a crane hook, and within ten more minutes the bowl assembly is resting on the ground on its downward extension arms 222. The benefits are extremely rapid and easy removal of the bowl assembly for changing wear liners or quick access to the interior of the gyrating mechanisms, and most important huge cost savings to its owner. FIG. 42 is a radial view; members 300, 289, 291, 290, and 292 are better shown in detail on FIGS. 43 &44. Manifold tubes 293 will turn within header plates 295 that contain sealing means on their inner faces and bores similar to 292 and 317; when 275 is tilted outward; tubes 290 slides within connectors 289 and 292 because 290 is centered on 293 which is a longer radius than radius R; this requires space 318 to allow sufficient slip distance; because 290 can slip, it acts as a piston which tends to tip cylinder 275 opposite to 290 thereby putting side pressure on bushing 310 and bending forces on piston rod 307; to neutralize this force we use a formula that uses the area of $_D$less the area of $_S$divided into the area of $_d$multiplied by $_L$equals $_N$where $_L$is the centerline distance of 275 and 290, and then pads 301 are made twice $_N$and are welded to one side of anchor plates; 297 is a saddle block that must be removed so 293 can be lowered far enough to extract 290 from its slip connectors; when in place it and column 298 support the thrust of 290. In FIG. 43 300 is an air bleed; 289 is fused to 275; 317 are high pressure elastomer seals; 323 is a small angle in 289 and 292 to accommodate both ends of 290 from binding in 289 and 292; 316 is a pipe plug to release air when inserting ram 307 into piston 306 when the threads are coated with an anaerobic locking fluid; 316 is then tightened; 313 is a plastic back-up ring; 314 is a high pressure elastomer seal; 315 is a nonmetallic wear band; 289 is a right angle connection fused to cylinder 275; 303 is a taper that in FIG. 44 a threaded cylinder head with seal ring 308 set in groove 322 seat against. High pressure seal 311 is installed; bushing 310 is inserted and retaining ring 309 is inserted; rod wiper 312 is inserted; the cylinder head assembly is slid onto ram 307; the piston and ram assembly is inserted into cylinder bore $_{D;}$; $_{D'}$ allows seal to pass oil entry port without being damaged and also to facilitate unobstructed oil flow if pistons are ever pulled to touching the cylinder heads; cylinder head 305 is then screwed into 275 and tighten to refusal on taper 303; a pin wrench engages holes 319. 321 are taper threads to bind tightly with the tapered threads in clevis 280 which is next installed; the tops of links 276 are machined 90 deg. to center lines of pins 277 and stepped to clear welds this forces 275 to pivot at the lower pin hole of links 276; said links could be eliminated by having two members 324 spaced apart and welded to the cylinder head, but the link design gives more flexibility. Hook-like members 281 are pinned to clevis 280; a hole 302 is drilled in 281 on or near the center line of gravity of the assembly; this provides a simple means for lifting by mechanical means each assembly into working position, and the use of a tool to enable one person to swing the hooks outward and return to operating positions. Angles β and $_{\Theta}$are limiting tipping angles that stop 275 and 281 at positions that give ample clearance when removing and reassembling bowl nut 220

Figures 45, 46:
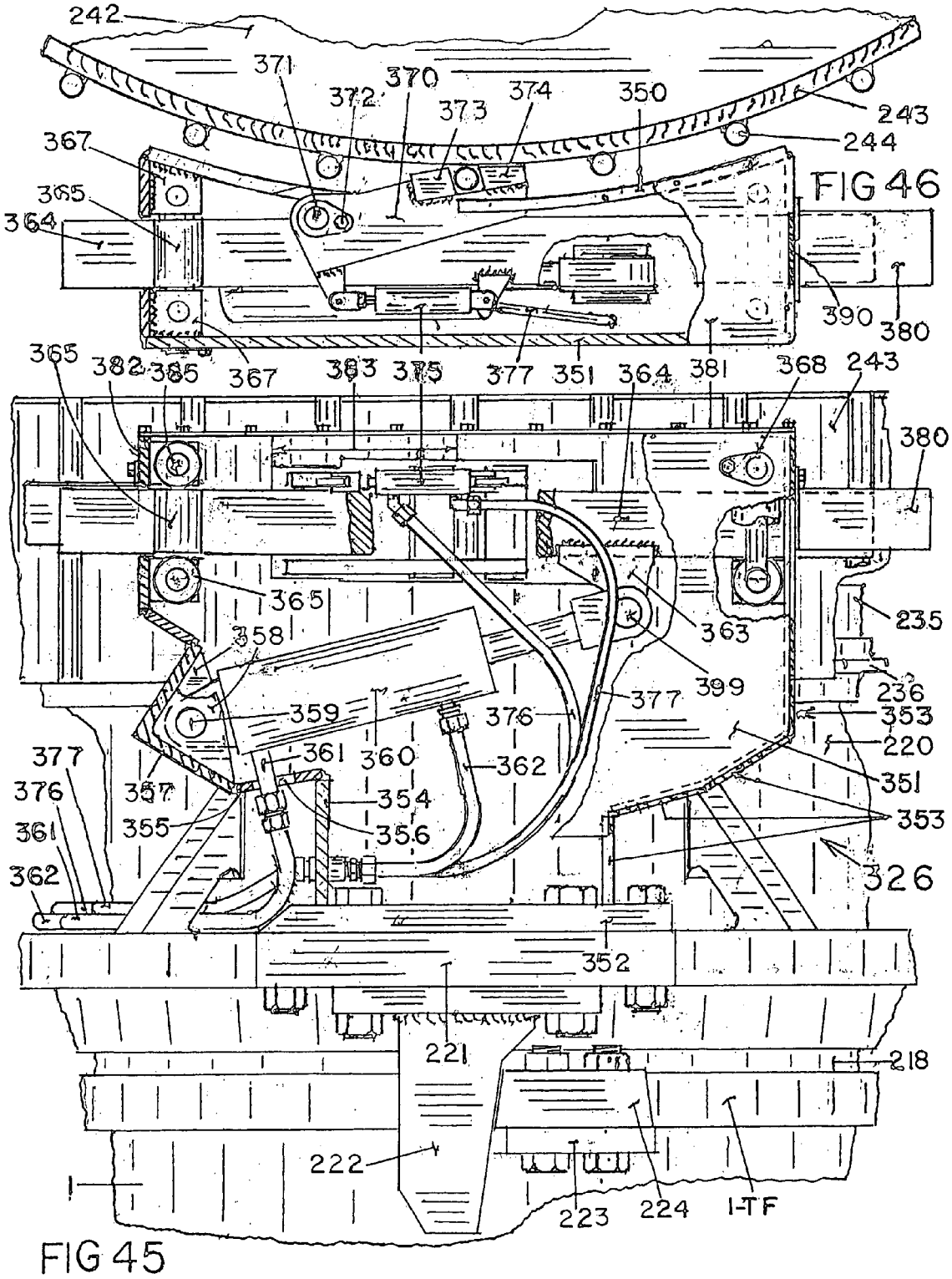
FIG. 45 is a tangental vertical partially sectioned view through our power adjustment system 326 and part of top frame 1-BA. 222 is a depending arm; 223 is a fixed platform; 224 is a reversible stop block; 352 is a base plate; 353 are spacing end plates; 354 is a spacer plate with hydraulic couplings through it; 355 is a spacer plate with slot 356 through it; 357 is an angle iron spacer and thrust absorbing member; 358 are gussets welded to 357; 382 is a spacer end plate. 350 is an arcuated inner wall; 351 is a flat outer wall; 360 is a push/pull hydraulic ram; 359 are coupling pins; 361, 362,376, and 377 are hydraulic hoses; 364 is a sliding bar; 363 is a bracket welded to 364; 365 are guide rollers; 385 are key axles; 368 are axle locking arms; 383 is a section cut out of wall 350.
FIG. 46 is a plan view of FIG. 45; 242 and 244 are a section of the adjustment ring 243; 370 is a bidirectional pawl; 371 is its pivot axle; 372 is an axle locking arm; 373 and 374 are extended grippers; 375 is push/pull hydraulic ram; and attached to cover 381; 380 are cover guards over 364.

FIGS. 45&46: 326 is one of two power adjusters set 180° apart for balanced torque that rotate member 243, an adjustment ring, to adjust the gap between bowl liner and mantle to obtain desired product sizes. 243 is bolted to bowl member 240 that when turned changes crusher setting. Our adjusting mechanisms work in parallel as follows: a control console, not shown, contains an electric motor driving a high pressure hydraulic pump powers all the adjustment cylinders and the hydraulic oil to the relief system; spool valves manually controlled or remotely controlled direct hydraulic oil in sequence. To close the setting the pawls 370 are swung open by cylinder units 375 and rams 364 are pulled to the left by cylinder units 360 to stopped positions; valves direct oil to 375 which pulls pawls 370 to swing inward gripping two opposed lugs 244 between grippers 373 and 374; lock nut 235 is depressurized, and ram units 360 push 364*s* thereby turning bowl 240 one chordal length between lugs; as 240 turns, pawls 370 are forced to move outward and inward slightly but enough to cause harmful pressures, this is alleviated by a small accumulator in series with 370*s*. At the end of the stroke of 360*s* the locknut is pressurized to hold the bowl to the new position; if desired to move more than one lug, the sequence is repeated as many times as necessary. To open the setting the sequence is same except the starting position has rams 364 fully extended opposite to closing position, and the double acting spool valve is moved opposite to closing and cylinders 360 pull. This concept resembles our U.S. Pat. No. 4,351,490 issued Sep. 28, 1982. However, that design proved to be too limber, and its open design subjected it to being jammed by rocks filling its spaces and cost labor and lost time to clear jamming, and slide pads that guided the equivalent to 364 were not very satisfactory. Our improved concept incorporates an arcuated inner wall extending from base plate 352 to cover 381; said wall is only open to accommodate the size and travel of pawl 370; an outer wall is flat and tangent to inner wall but has openings to access for assembling and servicing the members that activate the adjusting mechanism; said walls are spaced apart by end members 353, 354, 355, 357, and 382; member 357 is configured to cope with substantial thrust and pulling forces; spaced apart triangular plates 358 are welded to 357 and are drilled to accept one pin 359; plates 358 straddle the "eye" plate of cylinder 360; a hole in member 351 aligns to said holes in 358; pin 359 extends from outside of sideplate 351 to through the inner plate 358, and said pin is retained in place by an arm and cap screw not shown but is similar to 368; section 383 is cut out of said wall and then is attached to cover 381; this enables it to assist the partial closure of 350 but allows vertical assembly of ram 364 and pawl 370 to rest on rollers 365. Ram 364 has a bracket 363 welded to it at a specific location; the ram of unit 360 is pinned to said bracket by a second pin 399; ram 364 is tilted to the same angle as the thread angle, but the pawl 370 is angled relative to said ram to make it 90° to the lugs 244; this enables grippers 373 and 374 bear against lugs 244 without any vertical rubbing nor wear. Oil lines 376 and 377 when pressurized activate member 375 to open or close pawl 370; lines 361 and 362 when pressurized activate member 360 to push or pull ram 364; P.O. (pilot operated) check valves lock cylinder rams at whatever position each may be. Cover 381 has closures 383 and 390 attached to it to inhibit entry of contaminates; extended covers 380 cover ram 364 the full extent of said rams travel. Also shown are 222 and 224 that is bolted to platform 223 that is welded to 1-TF; these are multiple anti-rotation stops that restrain bowl nut 220 from moving circumferentially. Another advantage of our depending arms design is a ready made means of supporting the bowl assembly at a convenient height when it is set on the ground or floor; other crusher designs do not have similar depending arms and therefore require wood blocking to elevate their bowl assemblies to convenient height to provide space to drop worn liners out of the bowl; their system is slow cumbersome, and unstable.

Figure 48:
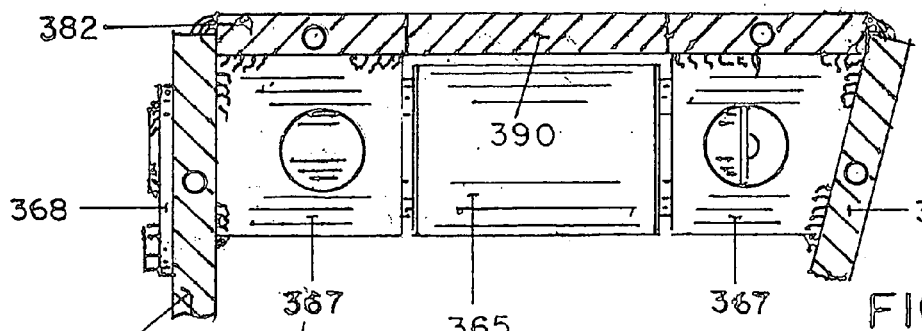
FIG. 48 is a plan view of FIG. 47; end spacer plate 382 is cut out for bar 364 at both ends; plates 390 FIG. 47 fill openings above 382.
Figure 47:
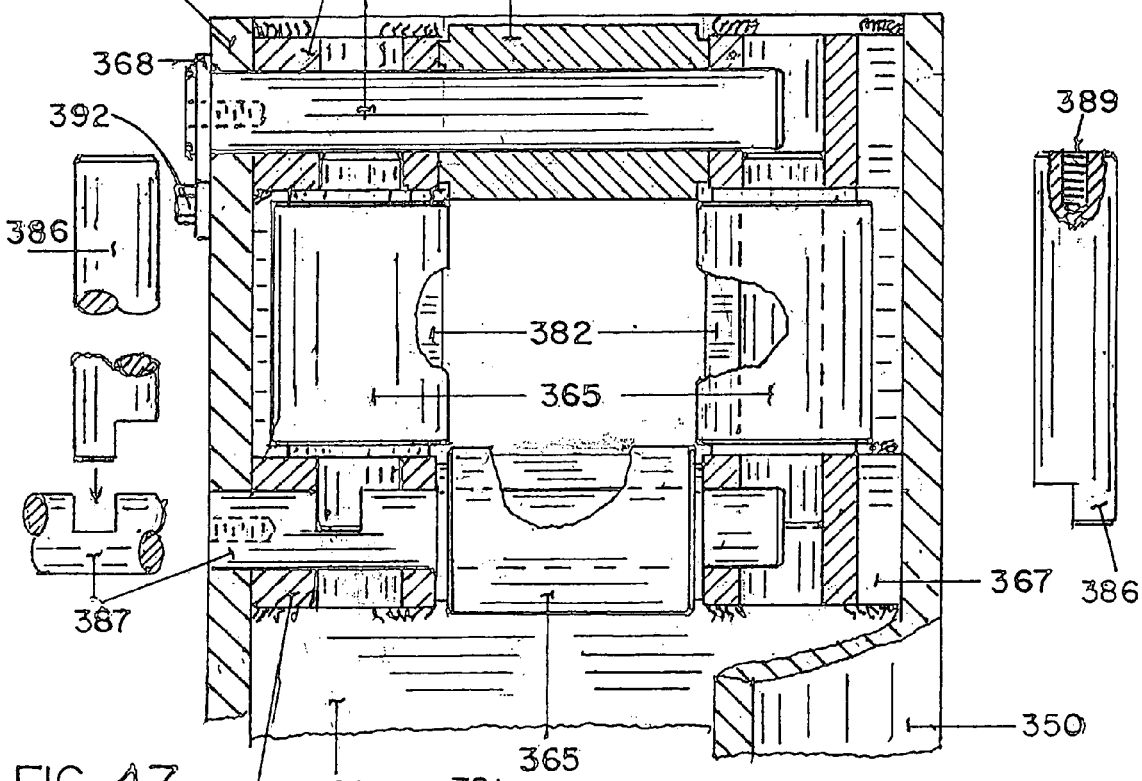
FIG. 47 is an inside vertical section view of one of the roller assemblies of 326; 367 are axle supports; 385 and 387 are horizontal axles and 386 are vertical axles; 389 are threaded holes; cap screw 392 locks arm 368.
Figure 49:
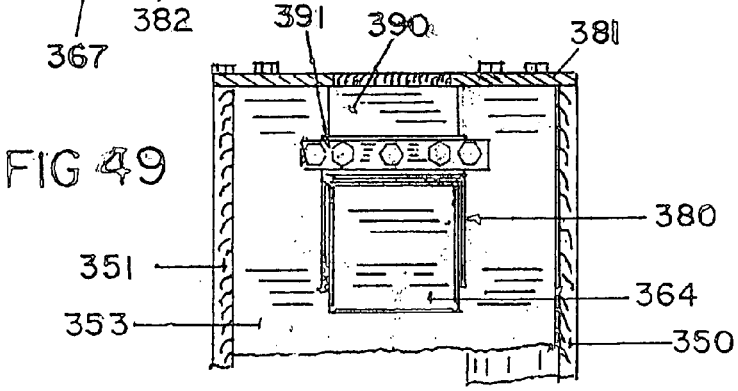
FIG. 49 is an end view of 326 adjusting assembly; 390*s* are attached to cover 381; 391 are clamps to hold 380.

FIGS. 47*s*, 48, 49. FIG. 48 is a vertical partially sectioned view showing an assembly of rollers and axles; to assemble 387 is slid through first lower block 367 then through a roller 365 and into far block 367. All rollers 365 are identical. Vertical axles 386 are identical; first axle 386 passes through first upper 367, through a roller, and into a notch in 387; the second 386 repeats the first except it rests on the end of 387; lastly axle 385 is slid through fist top 367 through a top roller and into far upper 367; arm 368 and cap screw 392 lock it. This design prevents axles from turning in 367*s* and secures them in place. Threaded holes 389 in the top ends of 386 axles facilitate their extraction. In actual assembly ram 364 is placed before top axle and its roller are installed. FIG. 48 is a plan view showing all axle holes in all 367 blocks are in the same plane. FIG. 49 shows a typical end view of rams 364 extending through openings in members 353 and 382 and under slot closures 390 welded to cover 381.

It is understood that the form of our invention herein shown and described is to be taken as a preferred example of the same, and that various changes in the shape, size and arrangement of parts may be resorted to without departing from the spirit of our invention nor the scope of the subjoining claims.

Having thus described our invention, we claim:

1. In a crusher of the gyrating cone type: a main frame supporting an annular base plate, a conical hollow spindle, an eccentric member, a cone head on said eccentric member, a hydrostatic lubrication between spindle and eccentric and conehead and hydrostatic lubrication to a spherical trust bearing; flow dividers proportioning lubricant to specified ports; hydraulic and threaded means retaining a conical wear mantle to said conehead; eccentric member attached to a drive plate with counterweights; double reduction gearing, a spherical thrust bearing, and an upper frame consisting of a bowl nut having internal threads lubricated from exterior means, and a threaded bowl within said bowl nut containing a replaceable conical wear liner retained by wedging means; an annular band with vertical bars on its exterior bolted to said bowl, and opposed housings containing hydraulic means to turn said bowl attached to said bowl nut; multiple hydraulic cylinders having attaching means at their closed ends are joined by linking means to anchoring means welded to said main frame and have their rod ends joined to hook like means that hook over the flange of said bowl nut with self aligning means; all said hydraulic cylinders are joined by sealed tubes to accumulator means that are gas pressurized; said cylinders operate in a pulling mode to hold said bowl nut firmly on seating means of main frame, and means to tilt cylinder and hooks outward to rapidly facilitate removable of upper frame assembly; said flow dividers positioned on exterior of main frame direct lubricant flow from outside of said main frame through protective ducting to chambers under said annular base plate where internal oil lines conduct lubricant and coolant to designated connections; multiple depending anti-rotation stops restrain bowl nut to main frame from tangential movement relative to main frame and act as supports when upper frame is detached from main frame.

2. In a crusher as in claim 1: said main frame having a circular wall of rolled steel plate, top and bottom flanges, crossbeams full depth at their midpoint and radially a designed distance then tapering convergently to maintain approximate uniform strength, and having end plates welded to said beams, said endplates machined radially to match the inside diameter of said circular wall, and all parts joined by secure welds.

3. In a crusher as in claim 1: said main frame having full depth crossbeams machined radially across their top a designed distance to fully support an annular plate centered on said beams and securely welded to said beams; below said annular plate three quadrants formed by arcuated steel walls of a designed depth having threaded holes in their lower edges for retaining cover plates, and a first quadrant for enclosing and supporting gearing means; said annular plate machined to support and retain an upright conical member, sealing means, an antifriction bearing, and is drilled and threaded for lubrication piping.

4. In a crusher as in claim 1: an upright spindle flanged at its lower face for bolting to an annular plate and having a cylindrical section extending upward from said flange a designed distance and containing a hollow cylindrical chamber for partially enclosing a gear; above said cylindrical section a converging conical section having a taper large enough to prevent radial clamping by an overlaying member and above said taper a second cylindrical section; said upright spindle is cast hollow for weight saving and for circulation of a heating or cooling liquid; said upright spindle configured to support and retain a spherical thrust bearing member and a cylindrical chamber capped at its bottom end, and its top end welded to a machined opening in said upright spindle.

5. In a crusher as in claim 1: an upright conical member having multiple oil holes positioned to supply oil pressured to provide hydrostatic lift and lubrication to lower and upper zones on its conical surface between said upright member, and an eccentric member journalled on said upright member; said upright conical member having a conical taper angle larger than any conical angle that might permit radial clamping by shrinking of a member rotating on said conical member.

6. In a crusher as in claim 1: an upright conical member bolted to a base plate; oil ways drilled to supply oil to each of multiple vertical grooves or recesses on its exterior taper and to two annular grooves between a conical lower zone and a conical upper zone and to a cylindrical extension above said conical upper zone.

7. In a crusher as in claim 1: an upright column drilled and ported with multiple holes from its bottom face to recessed elongated pockets machined into its conical surface at designed positions, and other holes to its top end that engage smooth bore holes parallel to the axis of said upright column; short cylindrical members having axial holes and sealing means on their outer surface are inserted in said smooth bore holes and extend through shims into a thrust bearing member bolted to the top face of said upright column.

8. In a crusher as in claim 7: a member having a conical inside taper to match the taper of an upright tapered column journal on said upright column and has an outer conical taper larger than its inner conical taper, and the axis of said outer taper intersects the axis of the inner conical taper at a designed distance above said member and diverges outward from the axis of said inner conical taper as it projects downward; the plane formed by said axis passes directly through the center of gravity of an extension of a counterbalancing member to which said conical member is attached.

9. In a crusher as in claim 1: a rotatable one piece eccentric member normally composed of cast bronze or other suitable bearing material; the bottom face of said eccentric member is drilled and threaded for cap screws and keywayed for drive keys for attaching to a driving counterbalancing member; said eccentric member having a conical bore and a larger conical outer surface and inner and outer cylindrical extensions concentric to their respective axis; said cylindrical extensions have arcs subject to radial loads separated by recessed arcs that are not loaded.

10. In a crusher as in claim 1: a counterbalancing plate member having a radius through an arc of approximately 180° and tangential sides extending to an arc of longer radius forming a counterweight with means to add additional counterweighting means as required to achieve dynamic balancing of a gyrating mechanism, and a means to attach a gear and sealing means to its lower face, and its top face having a means to attach a conical eccentric member and configured with a recess canted 90° to an eccentric axis and sealing means.

11. In a crusher as in claim 1: a concentric counterbalancing member of designed thickness having a perimeter with one radius through approximately 180°, tangential extending sides, a longer radius from one tangential side to the other tangential side and having a bored hole concentric to said two radii and to the axis of the inner conical bore of a rotating eccentric conical member and has a larger bore than the diameter of the lower cylindrical section of a nonrotating upright conical member that it surrounds, and the lower face of said counterbalancing member operates 90° to its axis of rotation, and a portion of its upper face is recessed parallel to its lower face where it is attached and keyed to said rotating eccentric member; an outer recessed portion of said counterbalancing member is canted 90° to the eccentric centerline of said eccentric member which has an axis angular to the axis of rotation; said canted portion is machined to retain a sealing ring and has annular recess for operating clearance for the rim of a gyrating eccentrically canted member and for draining lubricating oil and holes for draining said oil, and its top surface supports adjustable counterweighting means.

12. In a crusher as in claim 1: a rotating member attached to an eccentric member and having an arc of extended radius and thickness to serve as a counterbalance and support for attaching additional counterweight plates as maybe required and embedded upright pins and cap screws to hold said additional counterweights against centrifugal forces and spaces between counterweight plates to allow fine dust to be ejected and to minimize dust buildup on the inside radii of said counterweights and spacing washers surrounding said upright pins and cap screws and having means to attach fine tuning counterweights to the underside of said rotating member and to do so without being hindered by any other members of the machine.

13. In a crusher as in claim 1: a gyrating member having an inner conical bearing surface matching the outer conical surface of an eccentric rotating member attached to a counter-balancing member driven by a two stage gear reduction, and said gyrating member has an outer conical surface upon which is mounted a conical wear resistant member; said wear resistant member seats tightly on a conical raised portion starting at its largest diameter and converging for a designed distance and is integral with said gyrating member, and forms a spaced apart relatively narrow gap inward for containing a self hardening liquid and continuing to a smaller conical opening where it contacts a washer having a conical outer rim and conical inner opening; a large cap screw having a head with a matching conical diverging surface seats within said washer; above said conical diverging surface a converging conical extension of said cap screw; the top face of said cap screw is configured to be turned with a wrench; the lower extension of said cap screw is threaded to turn freely into a female thread of a piston like extension threaded into a larger diameter piston with tapered threads tightened to refusal and sealed with an anaerobic sealant thread locker, and said larger piston has an elastomer sealing ring within an annular groove around its perimeter; said large cap screw having a partially threaded hole through on its centerline for retaining a wear resistant cap and access to hydraulic fittings.

14. In a crusher as in claim 1: a hydraulic operated piston having a lower diameter larger than the diameter of an upward extension thereby forming an area to achieve hydraulic force; said larger diameter having an elastomer sealing ring sliding in a bore near the top of a conical gyrating member, and said extension sliding in a smaller bore in the same gyrating member, and an elastomer sealing means positioned in said gyrating member to surround said extension, and said extension having an internal female thread extending downward to a flat face that is drilled and taper threaded to a designed depth where an angled hole intercepts it; said angled hole exits at the juncture of said cylinderical extension and said larger diameter; a valving mechanism engages said taper threaded hole, and has a commercial hydraulic fitting to receive an oil pump nozzle followed by a spring loaded check valve, and a second valve seated by a cap screw and an exit port above said seat; means to access said valve with an extended oil pump nozzle and an extended wrench.

15. In a crusher as in claim 1: a hydraulic pulling piston embedded within a gyrating member and having sufficient area to adequately retain a gyrating wearing member and having at least one pin pressed into axial parallel holes in its disc, and said at least one pin projecting into respective clearance holes in said gyrating member to prevent said piston from rotating relative to its position within said gyrating member.

16. In a crusher as in claim 1: an upright conical member attached to a base plate at its largest diameter; a thrust bearing member attached with a force fit to the top of said upright member and shimming means for vertical adjustment; cap screws retaining said thrust bearing member and passing through said shimming means to prevent shims from moving; said shims insertable and removable with thrust bearing in place, and a jacking means to provide clearance between the top of said conical member and thrust bearing's seating face to provide space for inserting and removing shims and for extracting said thrust bearing member.

17. In a crusher as in claim 1: a lower part of a thrust bearing member having an attachment to an upright conical member for support; a steel member configured to said upright conical member an opposed face having a concave spherical surface the radius of which is centered at the vertex of the axis of said upright conical member and the axis of an eccentric member said radius of a length somewhat longer than the finished surface of said thrust bearing; an overlay of bronze or other bearing quality material deposited on said spherical concave surface and of a sufficient thickness to be machined and to retain an adequate wear life and to have a finished spherical surface having the correct radius and said thrust bearing member having an opening through its axial center to provide operating clearance for a gyrating universal joint.

18. In a crusher as in claim 1: a metal disk flat on the one side, the opposed side having a spherical shape with a radius equal to the distance of said spherical side to the vertex of two converging axis, and said spherical surface is hardened and super finished; said disk is centered in a recess directly below a hydraulic pull piston and is retained by cap screws; said disk having a center recess to contain a universal joint; with one half attached to the bottom face of said recess by cap screws, and its other half having one half of a jaw clutch attached to it; said jaw clutch having means to self align for blind assembling with its mating half; said mating half is attached to one half of a slip spline; the other half of said slip spline is joined to one half of a second universal joint; a preloaded coil spring surrounds the assembly of joined splines; a retaining means prevents the spring from disengaging said spline; a hydraulic motor is suspended by a flanged tubular means attached by cap screws to a shouldered recess in an upright column, and said motor is attached by bolts to the lower face of said tubular member; the lower universal joint is coupled to the motor shaft; a valving mechanism permits free flow of oil though the motor and retrograde rotation but stops or resists oil flow in the direction of an eccentric rotation; a spring loaded adjustable valve will bypass oil if torque motor exceeds certain pressure, and the entire mechanism is contained within a fluid tight enclosure.

19. In a crusher as in claim 1: a hydraulic motor is suspended by a flanged tubular member within a liquid tight chamber; said tubular member has an outward flange at its top end that is retained in place by cap screws within a recessed conical member; its bottom end is flanged inward and bored to match the centering boss of said hydraulic motor and is drilled and threaded for attaching said motor by bolts and locking nuts thereby holding the body of said motor against rotating; a universal joint is coupled to said hydraulic motor, and valving retards motor shaft rotation in one direction only.

20. In a crusher as in claim 1: rectangular members drilled and threaded to conduct lubricant and to conduct heating or coolant fluid from the exterior of a main base wall to within specific chambers under said base plate, and their outer ends connected by piping to flow dividers, and their inner ends connected to individual piping which connect to specific holes through said base plate, and their exterior surfaces of said rectangular members are protected from abrasion by crushed products.

21. In a crusher as in claim 1: lube oil lines from flow dividers to lube oil passage ways drilled through rectangular members; separate oil lines conduct controlled volume of lube oil from said rectangular members to individual connectors in said base plate.

22. In a crusher as in claim 1: an upright conical member attached to said annular base plate member by cap screws and having larger conical zone below an annular groove and a second annular groove above the first annular groove and a smaller conical zone above said second annular groove and individual means to supply lubricant to each groove from a two part flow proportionater; holes drilled through the wall of said eccentric member having their inner openings approximately centered to said grooves and extending radially to individual elongated pockets machined into the outer conical surface of said eccentric member; said first groove connects to pockets in the lower larger zone, and the second groove connects to pockets in the smaller upper zone; the outer ends of each hole are taper threaded to receive nozzles with holes sized to proportion lubricant volume to each pocket as required.

23. In a crusher as in claim 1: an annular base plate drilled for multiple lube oil holes spaced apart as designed; the bottom ends of said oil holes threaded to receive oil fitting connectors; the top ends of said oil holes recessed concentric to each of said oil holes to receive oil seals, two larger holes for entry and exit of a heating/cooling fluid machined and sealed similar to said lube oil holes; said base plate recessed to receive and hold an upright conical member against shearing forces, and holes aligned to oil holes in said conical member, and holes aligned to said heating/cooling fluid holes in said conical member, and threaded holes aligned to bolting holes drilled through a flange of said conical member.

24. In a crusher of the gyrating cone type: a main frame containing or supporting all the gyrating mechanisms, driving means, and support means to an upper frame assembly; said main frame having an upstanding male vee ring pressed into the top inside diameter of said main frame upon which seats a separable upper frame called a bowl nut having a matching inverted annular female vee groove that is formed integral within said upper frame, an annular flanged diameter section rising above said vee groove and extending to a larger diameter than said vee groove; extending outward of said larger diameter are platforms for attaching adjusting mechanisms and antirotation stops; inward from said vee groove is an annular vertical extension having an opening containing a section of female threads which extend upward above said annular flange to a smaller diameter flange positioned a designed distance above said vee groove; below said threads an annular cavity slightly larger in diameter than the root diameter of said female threads; below said cavity an annular surface slightly smaller in diameter than the inside diameter of said female threads and projecting downward below the lowest edge of said vee groove with an annular groove machined in its inner surface; the outer diameter of the upward projecting section has multiple angled braces evenly spaced circumferentially and having openings within said braces for retaining hydraulic hoses; above said smaller diameter flange is a separate annular ring having the same outside diameter and one or more threads having the same inside diameter, pitch, and contour as said female thread; said threaded ring is restrained against rotation by pins but is movable vertically a limited distance; said pins having enlarged diameter heads and shouldered within said ring and stepped holes shouldered in the top flange of said upper frame and are retained by threaded means; multiple hydraulic cylinders having rectangular bodies are bolted to the under face of said top flange, and all cylinders are connected in series by metal tubing or hydraulic hoses and have one or more connections to hydraulic oil supply; centered above piston in each cylinder are holes through said top flange, and in each hole are push rods of a length equal to the distance from the top face of said top flange to the pistons' lowest positions in said cylinders; a rotatable annular member having a cylinderical outer diameter extending from its lowest edge a designed distance to male threads, having a matching pitch and contour to said female threads, extends to the top surface of said annular member where bolts attach an annular plate having an inside diameter centering on said rotatable member and an outside diameter slightly larger than the outside diameter of the top flange of said upper frame; a cylindrical band of designed width has its top edge welded to the rim of said annular plate, and around said band are welded equally spaced steel bars parallel to the axis of said rotatable member; mounted on two extended platforms of said upper frame 180° apart are upstanding chambers having inner walls concentric to said rotatable member and spaced apart outer flat walls; contained within each chamber is a slidable rectangular means guided by rollers near each end of chambers; said rollers turn on interlocking axles with one axle removable before other axles can be removed and is inserted after three axles are inserted; an arm welded to one axle is retained by a cap screw and all axles are restrained from turning; hydraulic actuated pawls pivot on rectangular means engaging and disengaging steel bars simultaneously, and pivoting hydraulic rams push/pull rectangular means the chordal distance between bars, means to supply all hydraulic means with hydraulic power; means to restrain upper frame from lifting while crushing crushable material but yields to noncrushable objects and means to restrain said upper frame from creeping circumferentially, said rotatable member having a conical inner concentric surface larger at its lowest edge and converging upward to a central opening; a seating surface for a replacible conical means having a top outward flange slightly smaller in diameter than the central opening of said rotatable member with a conical under surface; sliding wedges engage said under surface and are urged inward by thrusting means and are clamped vertically and enclosure means to protect against entry of rain and solid matter.

25. In a crusher as in claim 24: an annular frame having an inverted vee shape, a concentric female thread; two opposed extended platforms supporting attached upstanding means to power turn a rotatable threaded member, and multiple extending platforms for attaching downward projecting beams; said beams bear against reversible stop blocks attached to platforms welded to the underside of the top flange of said main frame.

26. In a crusher as in claim 24: a means of adjusting the space between a fixed wear member and a gyrating wear member to control product sizes and compensate for wear and to separate a rotatable member from a fixed member, said means of adjusting to be a fixed member having a female thread and a rotatable member having a male thread, said threads to be angled on their loaded faces at larger angle than the bisecting angle of the crushing chamber to avoid outward radial sliding; the female thread to have a greasing groove its full length with both ends blocked and blocked intermittently; lubrication holes from said groove between each blockage to the exterior of said fixed member; manual or automatic means of injecting grease into said holes.

27. In a crusher as in claim 24: a means to clamp a rotatable member from turning within an upper frame member while the machine is crushing; said clamping means to be a ring like member having at least one full internal thread and a means to restrain it from rotating, said clamping means to be forced vertically by hydraulic means, said hydraulic means to be multiple rectangular members bolted to the underside of a top flange of said fixed member, said rectangular members bored for short stroke pistons and connected in series by hydraulic lines and to a pressure source at one or more spaced places; centered over each piston is a vertical hole through said flange with a push rod reaching from a fully relaxed piston to flush with the top of said flange, and with all moving parts totally enclosed to prevent entry of moisture, dust, or other contaminants.

28. In a crusher as in claim 24: a power means to rotate a rotatable member positioned within a threaded bowl nut said power means having two enclosed housing each having an arcuated inner wall centered off the main axis of said bowl nut; an outer wall tangent to said arcuated inner wall and spaced outward by members at ends of said walls; said inner wall and lowest end spacers welded to a base plate that is drilled for bolting attachment; within each said enclosed housing is a slidable member that extends through openings in uppermost end spacing members, roller assemblies near each opening guide said slidable member, a push-pull hydraulic means is pin connected to said slidable member and to a spacing member; said slidable member is angled to a thread angle; a swingable pawl journalled to the inside face of said sliding member has its pivoting axis parallel to the centerline axis of said rotatable member and having vertical bars at end of pawl and parallel to the same axis; said bars spaced to closely straddle multiple evenly spaced vertical lug bars on a second rotatable member; said pawls are actuated by hydraulic means; an opening in said arcuated wall to allow said pawl to swing through and travel within said opening the length of travel of said sliding member; said sliding member extends beyond said enclosure at each end of its length of travel with covers to protect said extensions; a cover member encloses the top of said housing; each power means bolted to platform extensions integral to a flange of said bowl nut and 180° apart.

29. In a crusher as in claim 24: a rotatable member having an inverted conical interior with a designed size of top opening and having flat surface at top of said opening formed by segmented steel plates welded over cast cored pockets that form radial struts from an outer wall to an inner conical wall; three or more evenly spaced slidable wedges having conical ramps that match the conical flange of a wearing member and having elongated slots midway of their lengths and vertical slots at the opposite end of wedging ramps; thrusting means with bolt heads locked against turning in said vertical slots, nuts on said bolts, washers, and steel thrust blocks drilled for bolt clearance and welded to said segmented plates directly above three or more radial struts; holes drilled and threaded through said plates and into said radial struts for cap screws positioned to allow wedges to travel from edge of said opening inward; guides prevent wedges from skewing.

30. In a crusher as in claim 24: slidable wedging means actuated by thrusting and clamping means for retaining and releasing a conical member seated within a rotatable member.

31. In a crusher as in claim 24: two hydraulic powered members bolted to platforms integral to a non rotating threaded member and spaced 180° apart for balanced tangential forces; said powered members having pawls that grip lug bars integral to a rotatable member for either push or pull directions; said rotatable member is attached to a second rotatable member that is threaded into said non rotating threaded member; said pawls are powered to engage and disengage gripping said lug bars; accumulator means to accommodate varying hydraulic oil volume pressurized by oil captured between the pawls' hydraulic cylinders and a control valve as pawls are forced radially throughout their arc of travel thereby changing the oil volume within their actuating cylinders.

32. In a crusher as in claim 24: a means to accommodate passing uncrushable objects through a crusher and to have a means of rapid disassembling and reassembling of a crusher's upper frame and gyrating parts by hook like means coupled to tilting hydraulic cylinders which are connected to anchor means by linkage means; vertical tubing means slidable in header means with sealing means join cylinders to horizontal tubing means pivotable and sealed within header means bolted to anchor means having holes to pass fluid means to accumulator means.

33. In a crusher as in claim 24: multiple hook like members joined to concave annular plates seated on convex annular plates positioned over holes in a flange of a crusher's upper frame; said convex annular plates have pinning means to said holes; greasing means to inject grease between convex and concave surfaces; said hook like members shaped and coupled by pins to devises to allow limited tilting relative to said clevises, and said devises having female tapered threads coupled to a matching threads on hydraulic rams to form tight fits to resist uncoupling; hydraulic cylinders contain said rams and function in a pulling mode; annular headers threaded into female threads in said cylinders and seat against tapers with sealing means and have bushings and seals encasing said rams; extension plates welded to the bottom covers of said cylinders are offset toward vertical tubes in proportion to the area of each cylinder less the area of the ram to the area of the vertical tube's outside diameter to counter the thrusting force trying to eject said tube; said extension plates have holes for connecting links and pins for coupling to anchor means.

34. In a crusher as in claim 24: header plate means aligned on each side of anchor plate means and retained by bolts through both header plates and anchor plate and sealed on their contact faces, and anchor plates having holes of about the same size as hole size of horizontal tubes; said header plate means having holes bored at an angle to align with header plates sharing the same horizontal tubes; said header having sealing means enclosing said horizontal tubes allowing said tubes to turn in said headers; annular means shaped to the diameter of said horizontal tubes on one end and their other end step bored to the diameter of vertical tubes and inside diameter of said tubes and sealing means enclosing said vertical tubes and welded over holes in said horizontal tubes inline with headers fused to cylinders.

35. In a crusher as in claim 24: pivotable tubes journalled in sealing headers joining multiple cylinder assemblies spaced around a crusher frame and connected to one or more accumulators; vertical tubes join headers fused near tops of cylinders to headers fused to said horizontal tubes; cylinders tilt outward with hook like means coupled to cylinders or hook like means can be tilted with cylinders remaining in fixed positions; valving means connect hydraulic oil supply hose to an anchor plate drilled and threaded to connect to its manifold oil hole and retain a valve; all said headers have close clearance fits to tubing means between sealing means and their outer ends but are tapered bored between said sealing means and an inner face to accommodate for any misalignment of headers; said vertical tubes' headers are tapered bored to accomodated angle changes when cylinders are tilted, and vertical tubes are of a length to stop tilting after hook like means clear the flange of the upper frame.

36. In a crusher as in claim 24: a safety relief system for cone type crushers having one option for tilting cylinders and attached hook like links as one, and an option of tilting hook like links only where cylinders with manifolds are not made to tilt.

37. In a gyrating crusher of the cone type: a main frame having a circular wall and having top and bottom flanges with 90° cross beams contoured for approximately uniform strength across their lengths and with end capping plates to distribute weld concentration where joining to said circular wall; one of said beams full length and other beams in two sections abutting said one beam and fully welded to same and said beams full depth at their mid section; a circular member is centered on said beams and welded to same; said circular member of ample thickness to support all gyrating members and non gyrating companion members and having an annular oil drain recess with multiple drain holes; multiple oil passages and two heating/cooling fluid passages drilled through said circular member; three arcuated walls welded to said beams and said circular member form chambers in three quadrants and in one separate quadrant a gear chamber; openings in said beams and within said chambers for oil drains; means to conduct lube oil and heating/coolant fluid from an outer wall to within chambers formed by said arcuated walls; formed hydraulic lines from conducting means to specific connecting means in said circular support member and formed means to conduct and return heating/coolant fluid without mixing with lube oil and cover plates to close said chambers; a conical spindle secured tightly in a recess in said support by cap screws; said spindle having multiple passage ways for lube oil to specific outlets and with sealing means between said conical spindle member and said circular support member; said conical spindle having a hollow internal chamber with a low entry port with swirling means for circulating heating/coolant fluid and a high exit tube to insure a full chamber, a sealing means for said chamber and a sealing means between said spindle member and said support member, flow dividers and tubing members to distribute incoming lube oil to specific connectors in conducting members from outside of said frame wall to inside of said chambers, connections for hoses to connecting members for circulating heating/coolant fluid; a horizontal input shaft journalled in roller bearings within a tubular housing having sealing means, and said shaft having a spiral bevel gear at its inner end driving a mating spiral bevel gear of larger size driving its vertical shaft also journalled in anti-friction bearings and having a spur gear at the top end of said vertical shaft, means for adjusting the proper meshing of said bevel gears; said spur gear meshes with an internal tooth gear attached to a rotatable member which is attached to a conical eccentric member which rotates on said conical spindle; sealing means between said rotatable member and said support member; upon said spindle is attached a spherical thrust bearing vertically adjustable and having sealed tubular connectors to transfer lube oil between said spindle and said thrust bearing, hydrostatic means to lubricate said conical eccentric member and said thrust bearing; oil holes from the inside conical bore of said eccentric member aligned to annular grooves in said spindle conduct lube oil into grooves machined into the outer conical surface of said eccentric member; said holes having varying sizes of nozzles to meter hydrostatic oil flow to a gyrating conical member, and resting upon said thrust bearing and journalled on said conical eccentric member is said gyrating conical member having a replacable wearing member retained on said gyrating member by hydraulic and threaded means; said gyrating conical member is restrained from turning in one direction but is free to turn in the opposite direction; hydraulic motor, valving means, universal joints with slip shaft and a jaw clutch are restraining means; sealing means between said gyrating conical member and said rotatable member; said main frame has a vee-ring inserted into its top flange and upon said vee-ring rests a flanged member having an internal thread that has a groove in its loaded face; said groove is blocked at both ends and has intermittent blocking between said end blocking; between said intermittent blocking are lubrication means into said groove; at the bottom flange of said main frame multiple spaced apart anchor members are attached; all but two of said anchor members are ported for fluid passage, bolt holes above and below said ports; header means each side of said anchor members, said header means bored and sealed to align to headers on adjacent anchor members and sealed between header means and anchor members; hydraulic tubular manifolds extend from within header to within the next header except at power input sector and having one or more slip connectors, with sealing means, 90° to said manifolds said manifolds turnable within said headers; said anchor members drilled and pinned and linked to hydraulic cylinder means; vertical tubular members join said manifolds to said cylinder means; a rod means projecting from within said cylinder means is threaded into a clevis means; an extended hook like means is pinned to said clevis means and projects inward over said flange of said threaded member and is seated on said vee-ring with self aligning means between said flange and said hook like means; accumulator means connected in series with said manifolds and said accumulators are gas pressurized to a specified pressure range; hydraulic fluid is pumped into said manifolds, cylinders and accumulators to a specified volume and pressure; said cylinder means and said hook like means can be tilted outward after pressurized hydraulic fluid is drained to a reservoir; gas pressure in accumulators is retained; said threaded flanged member contains a rotatable threaded member that is free to be turned by powered means when unlocked; locking means is a ring with one or more threads above said flanged threaded member and is prevented from turning but can be moved vertically by multiple hydraulic rams bolted to the under face of the top flange of said flanged member; means thereby locking and unlocking said rotatable member; said rotatable member contains a replaceable wearing member that is retained in said rotatable member by sliding wedges having slotted means for clamping by cap screws after being forced inward by thrusting means; means to prevent circular movement of said flanged threaded member relative to main frame member by downward projecting means attached to said flanged member bearing against blocking means attached to the top flange of said main frame.

* * * * *